US010185256B2

(12) United States Patent
Inada et al.

(10) Patent No.: US 10,185,256 B2
(45) Date of Patent: Jan. 22, 2019

(54) IMAGE FORMING APPARATUS THAT DISCHARGES AIR TO A SPACE IN A MAIN ASSEMBLY

(71) Applicant: CANON KABUSHIKI KAISHA, Tokyo (JP)

(72) Inventors: Seiji Inada, Numazu (JP); Seiji Obata, Mishima (JP); Shizuma Nishimura, Suntou-gun (JP); Michio Uchida, Mishima (JP); Yoji Oya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/713,977

(22) Filed: Sep. 25, 2017

(65) Prior Publication Data

US 2018/0088499 A1 Mar. 29, 2018

(30) Foreign Application Priority Data

Sep. 26, 2016 (JP) ..... 2016-186487
Nov. 8, 2016 (JP) ..... 2016-217840

(51) Int. Cl.
*G03G 15/00* (2006.01)
*G03G 15/20* (2006.01)
(Continued)

(52) U.S. Cl.
CPC ..... *G03G 15/2017* (2013.01); *G03G 15/011* (2013.01); *G03G 15/06* (2013.01);
(Continued)

(58) Field of Classification Search
CPC ..... G03G 21/206; G03G 2221/1645; G03G 2215/0132; G03G 15/2017
See application file for complete search history.

(56) References Cited

U.S. PATENT DOCUMENTS 7,313,342 B2 12/2007 Katayama et al.
8,682,206 B2 3/2014 Iwasaki
(Continued)

FOREIGN PATENT DOCUMENTS

EP 1602989 A1 12/2005
EP 2 902 850 A1 8/2015
(Continued)

OTHER PUBLICATIONS

European Search Report dated Feb. 2, 2018, in European Patent Application No. 17192820.3.
(Continued)

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus for forming a toner image on a sheet includes a main assembly, an image forming station provided in the main assembly and configured to form a toner image on the sheet, and a fixing portion provided in the main assembly and configured to fix the toner image formed on the sheet, on the sheet, the fixing portion including a fixing rotatable member and a covering member covering the rotatable member. The image forming apparatus also includes a suction mechanism including a duct connected with an opening provided in the covering member, and a fan configured to suck air inside the covering member through the duct. The air sucked by the suction mechanism is discharged into a space in the main assembly other than a space through which the sheet passes.

16 Claims, 16 Drawing Sheets

(51) Int. Cl.

| | |
|---|---|
| ***G03G 15/01*** | (2006.01) |
| ***G03G 15/06*** | (2006.01) |
| ***G03G 21/20*** | (2006.01) |

(52) U.S. Cl.
CPC ..... *G03G 15/5041* (2013.01); *G03G 21/206* (2013.01); *G03G 2215/2035* (2013.01)

(56) References Cited

U.S. PATENT DOCUMENTS

| | | | | |
|---|---|---|---|---|
| 9,075,364 | B2 | 7/2015 | Iwasaki | |
| 9,291,996 | B2 | 3/2016 | Nakano et al. | |
| 9,405,272 | B2 | 8/2016 | Wachi et al. | |
| 9,658,580 | B2 | 5/2017 | Saito et al. | |
| 2007/0212104 | A1* | 9/2007 | Miyamoto | G03G 21/206 399/92 |
| 2008/0050144 | A1* | 2/2008 | Hashimoto | G03G 15/2017 399/92 |
| 2008/0063425 | A1* | 3/2008 | Idehara | G03G 21/1857 399/93 |
| 2011/0274458 | A1 | 11/2011 | Hijikata et al. | |
| 2014/0255057 | A1* | 9/2014 | Yoshino | G03G 21/206 399/92 |
| 2014/0341607 | A1* | 11/2014 | Nakano | G03G 15/2017 399/92 |
| 2016/0209806 | A1 | 7/2016 | Shiomi | |

FOREIGN PATENT DOCUMENTS

| | | | |
|---|---|---|---|
| JP | 07-160179 | A | 6/1995 |
| JP | 2002-278341 | A | 9/2002 |
| JP | 2003-146514 | A | 5/2003 |
| JP | 2006-106030 | A | 4/2006 |
| JP | 2007-206275 | A | 8/2007 |
| JP | 2008-116858 | A | 5/2008 |
| JP | 2008-241793 | A | 10/2008 |
| JP | 2012-118410 | A | 6/2012 |
| JP | 2014-224848 | A | 12/2014 |
| JP | 2014-224899 | A | 12/2014 |
| JP | 2015-094774 | A | 5/2015 |
| JP | 2016-184125 | A | 10/2016 |

OTHER PUBLICATIONS

Copending, unpublished U.S. Appl. No. 15/724,461, filed Oct. 4, 2017, to Yoji Oya.
Extended European Search Report dated Jun. 21, 2018, issued in corresponding European Patent Application No. 17192820.3.

* cited by examiner (a)

(b)

IMAGE FORMING APPARATUS THAT DISCHARGES AIR TO A SPACE IN A MAIN ASSEMBLY

This application claims the benefit of Japanese Patent Applications No. 2016-186487 filed on Sep. 26, 2016, and No. 2016-217840 filed on Nov. 8, 2016, each of which is incorporated by reference herein in its entirety.

FIELD OF THE INVENTION AND RELATED ART

The present invention relates to an image forming apparatus such as a printing machine, a copying machine, a facsimileing machine, etc.

An image forming apparatus that uses an electrophotographic recording method has a fixing apparatus that thermally fixes a toner image to a sheet of recording medium with the use of a combination of a heating member and a pressure roller. The fixing apparatus heats toner and recording medium at a high temperature. Thus, a part of the water that the recording medium contains turns into water vapor in the image forming apparatus. Therefore, it sometimes occurs that the water vapor condenses on the peripheral surface of the pressure roller of the fixing apparatus.

As the water vapor condenses on the peripheral surface of the pressure roller by no less than a certain amount, it sometimes occurs that the fixation film that contacts the pressure roller, and a sheet of recording medium that also contacts the pressure roller, slip on the peripheral surface of the pressure roller, resulting in the occurrence of paper jam and/or image defects. Moreover, in a case in which an image forming apparatus is started when it is low in temperature (cold start), the water vapor sometimes condenses into droplets of water on the surface of the conveyance roller, and/or that of the conveyance guide. These droplets of water remain adhered to the surface of the conveyance roller and/or that of the conveyance guide. If these droplets of water adhere to the sheet of recording medium, it occurs sometimes when the image forming apparatus is in the two-sided printing mode that the image forming apparatus outputs defective images.

In order to deal with the above-described problems, various attempts at solutions have been made. For example, in the cases of the fixing apparatuses disclosed in Japanese Laid-open Patent Applications Nos. 2007-206275 and 2008-116858, air is blown at the peripheral surface of the pressure roller to remove the droplets of water on the peripheral surface of the pressure roller. Further, in the case of the fixing apparatus disclosed in Japanese Laid-open Patent Application No. 2003-146514, the fixing apparatus is provided with a member for catching water droplets as they fall from the shaft of the conveyance roller.

The abovementioned fixing apparatuses suffer, however, from the following problems. That is, in the case of the image forming apparatuses disclosed in Japanese Laid-open Patent Applications Nos. 2007-206275 and 2008-116858, it is difficult to prevent droplets of water from adhering to the conveyance guide that is in the adjacencies of the fixation nip, and the conveyance roller that is on the downstream side of the fixation nip in terms of the recording medium conveyance direction, even though the water vapor in the adjacencies of the peripheral surface of the pressure roller can be removed.

In the case of the fixing apparatus disclosed in Japanese Laid-open Patent Application No. 2003-146514, the droplets of water on the peripheral surface of the pressure roller cannot be removed. Further, the droplets of water on the shaft of the conveyance roller remain adhered to the shaft until they fall from the shaft. It is not guaranteed that, as the conveyance roller is rotated, the droplets of water on the conveyance roller fall into a water droplet catching member. For example, it is possible that the droplets of water will be scattered onto, and adhere to, the surface of the conveyance guide and/or the surface of a sheet of recording medium.

SUMMARY OF THE INVENTION

The present invention was made to solve the above-described problems. Thus, the primary objective of the present invention is to provide an image forming apparatus that is capable of efficiently exhausting the water vapor that is in the adjacencies of the fixing means.

To achieve the above-identified objective, an aspect of the present invention provides an image forming apparatus for forming a toner image on a recording material, the image forming apparatus comprising a main assembly, an image forming station provided in the main assembly and configured to form a toner image on the recording material, a fixing portion provided in the main assembly and configured to fix the toner image formed on the recording material, on the recording material, the fixing portion including a fixing rotatable member and a covering member covering the rotatable member, and a suction mechanism including a duct connected with an opening provided in the covering member and a fan configured to suck air inside the covering member through the duct, wherein the air sucked by the suction mechanism is discharged into a space in the main assembly other than a space through which the recording material passes.

Further features of the present invention will become apparent from the following description of exemplary embodiments (with reference to the attached drawings).

Figure 2:
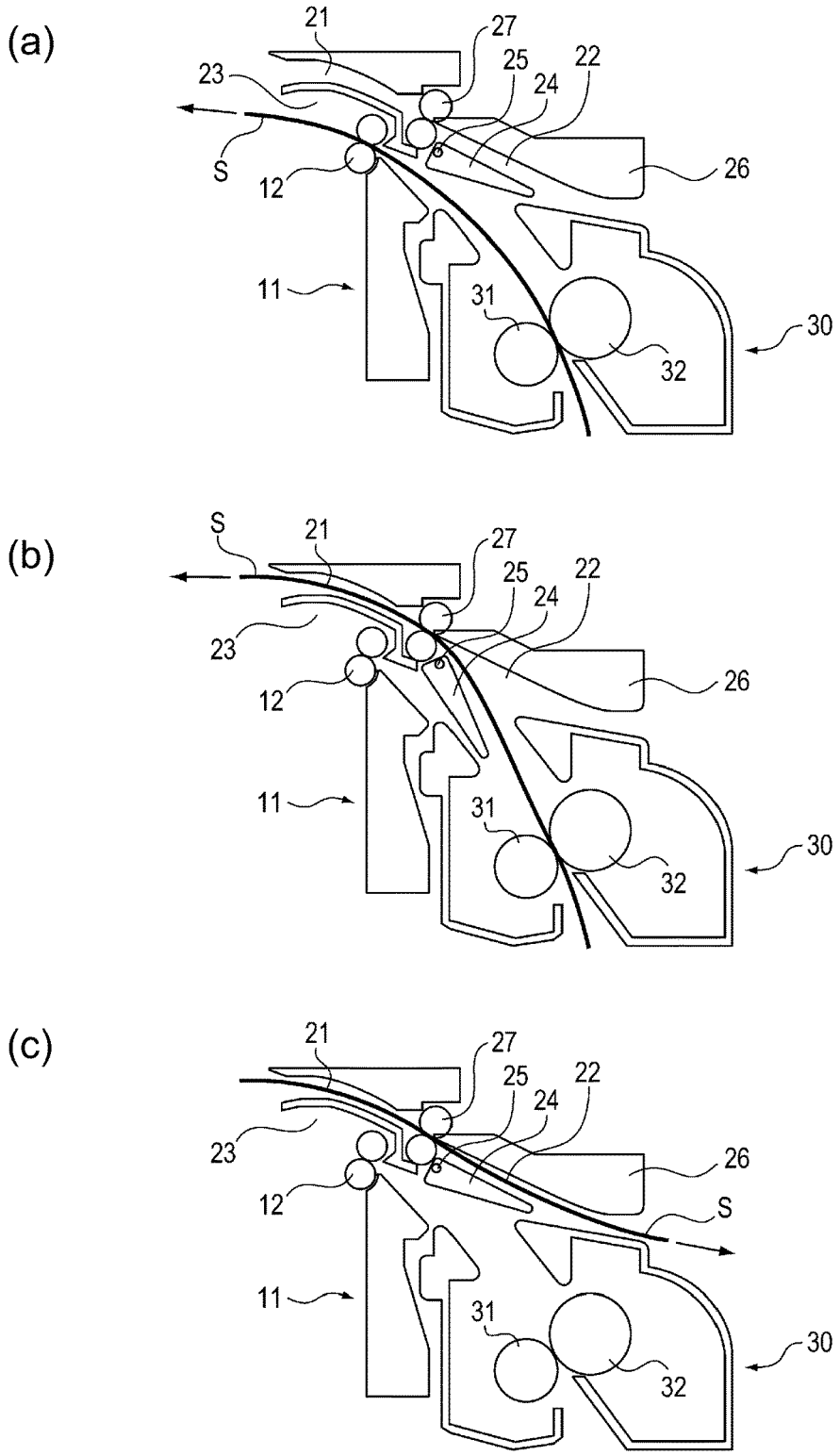

Part (a) of FIG. 2 is a sectional view of a combination of the fixing apparatus, and its downstream adjacencies, in the first embodiment, showing how a sheet of recording medium is discharged from the image forming apparatus. Part (b) of FIG. 2 and part (c) of FIG. 2 are sectional views of the combination, showing how a sheet of recording medium is conveyed to the recording medium passage for the two-sided printing mode.

Figure 3:
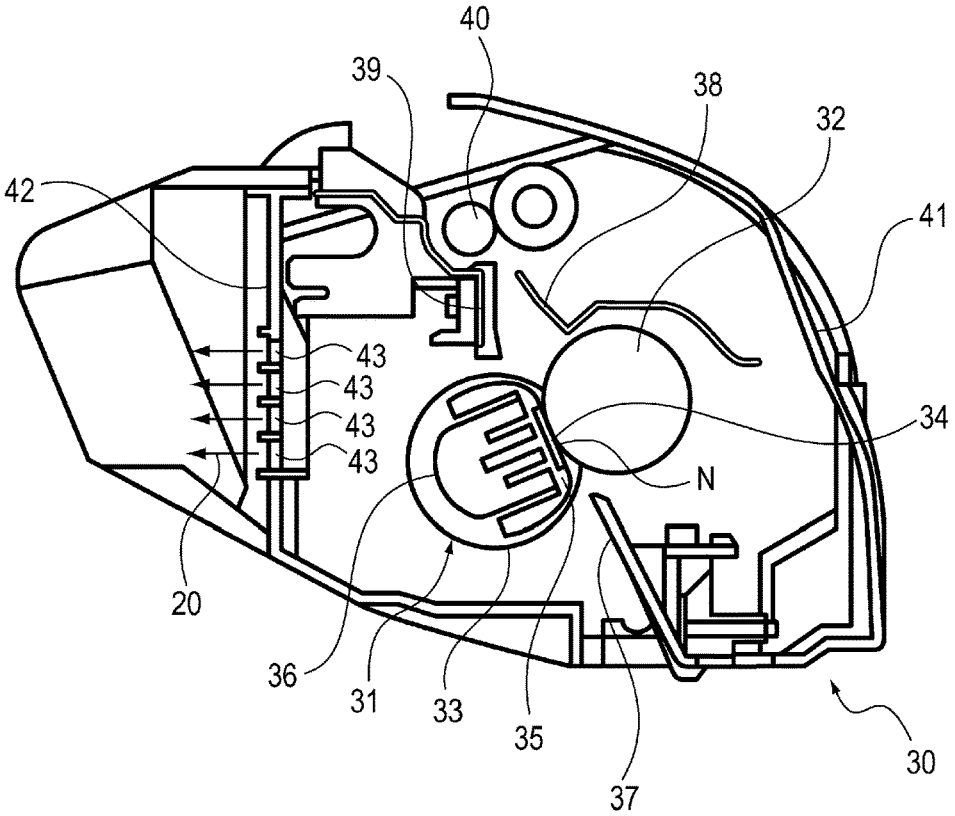

FIG. 3 is a sectional view of the fixing apparatus in the first embodiment, showing the structure of the fixing apparatus.

Figure 4:
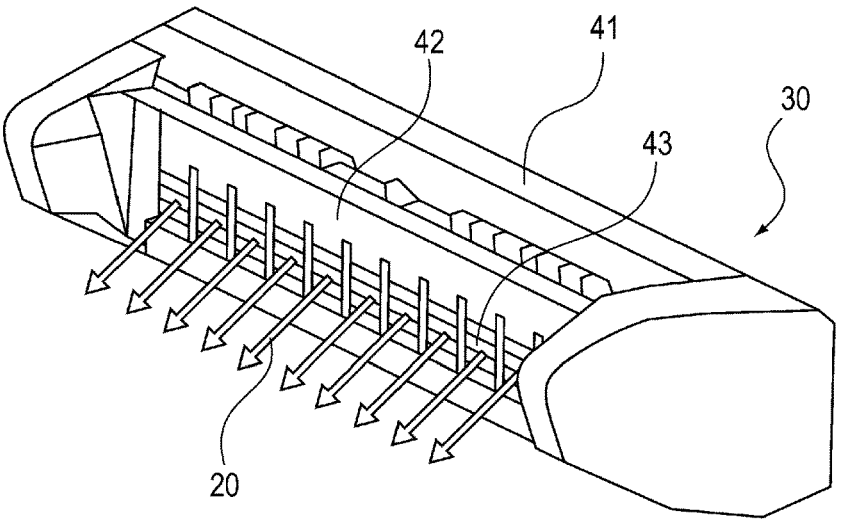

FIG. 4 is a perspective view of the fixing apparatus in the first embodiment, also showing the structure of the fixing apparatus.

Figure 5:
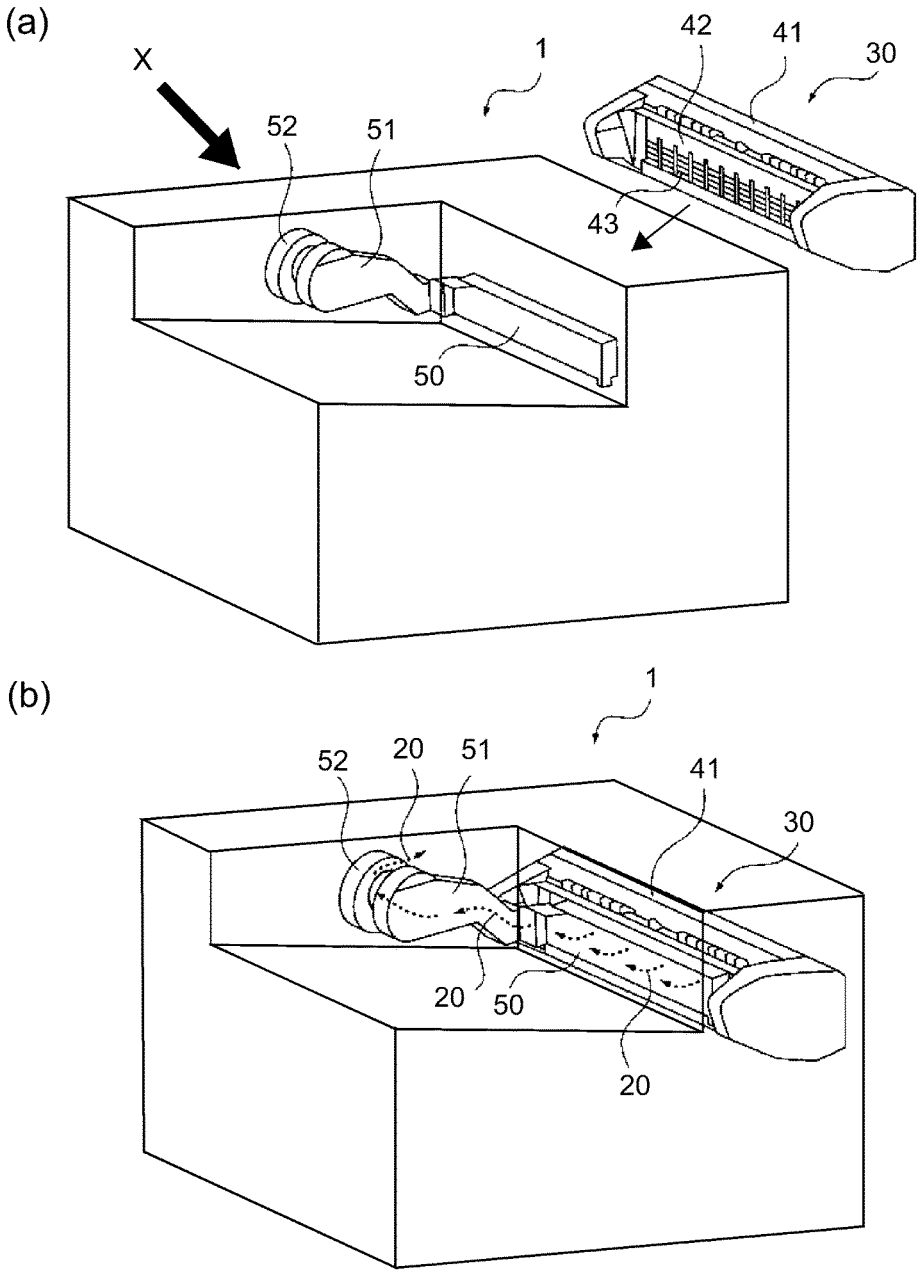

Part (a) of FIG. 5 is a partially phantom perspective view of a combination of the main assembly of the image forming apparatus, and the fixing apparatus therefor, in the first embodiment, as seen from the front side of the main assembly, showing how the fixing apparatus is installed into the main assembly. Part (b) of FIG. 5 is a partially phantom perspective view of a combination of the main assembly of the image forming apparatus, and the fixing apparatus therefor, in the first embodiment, as seen from the front side of the main assembly, after the installation of the fixing apparatus into the main assembly.

Figure 6:
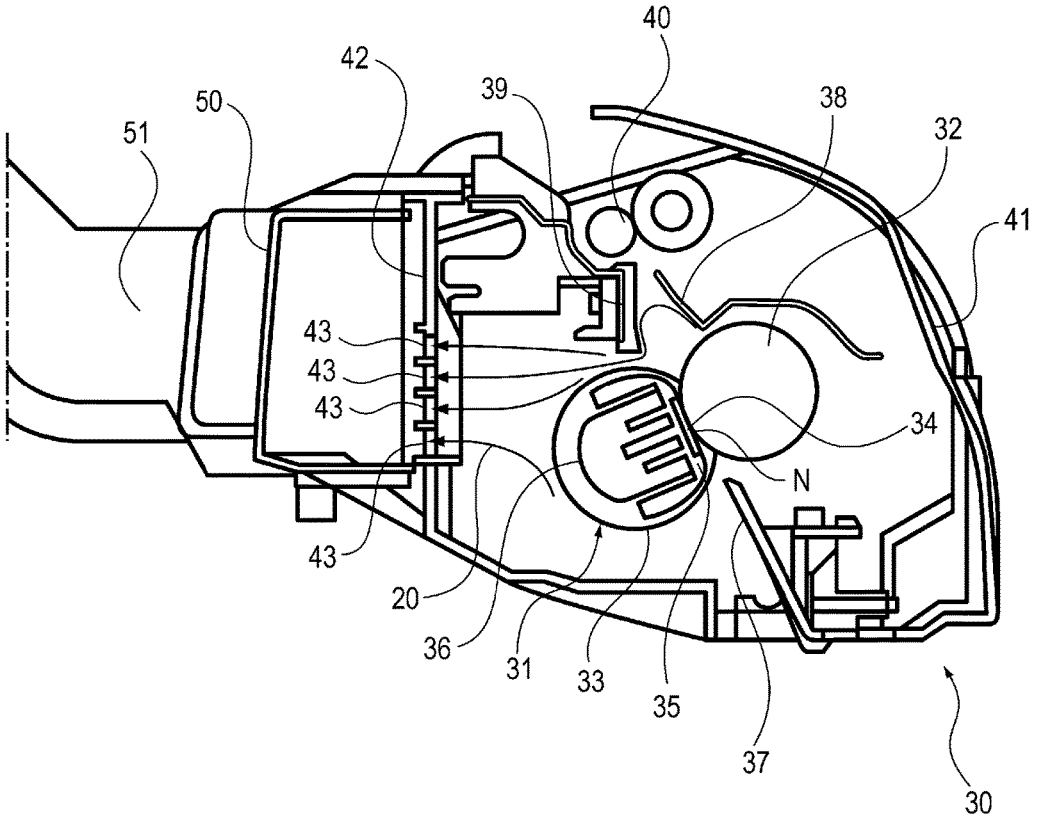

FIG. 6 is a sectional view of the fixing apparatus in the first embodiment, for describing the airflow passages in the fixing apparatus in the first embodiment.

Figure 7:
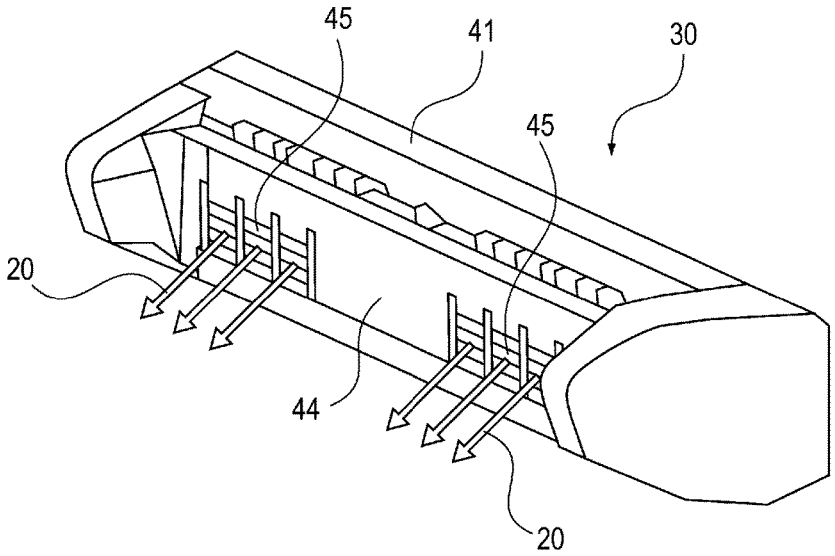

FIG. 7 is a perspective view of the fixing apparatus in the second embodiment of the present invention, for showing the structure of the fixing apparatus.

Figure 8:
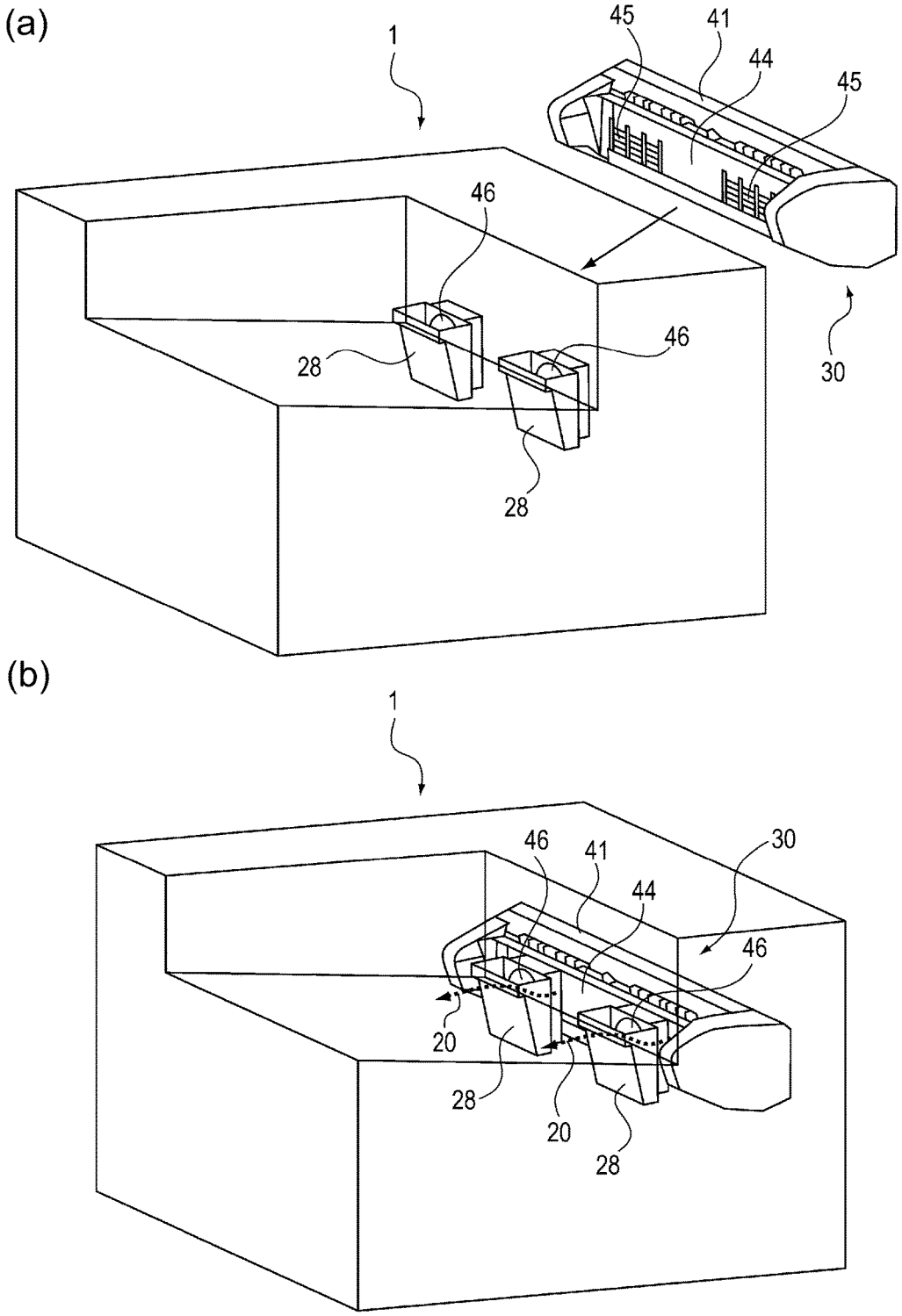

Part (a) of FIG. 8 is a partially phantom perspective view of a combination of the main assembly of the image forming apparatus, and the fixing apparatus therefor, in the second embodiment, as seen from the front side of the main assembly, for showing how the fixing apparatus is installed into the main assembly. Part (b) of FIG. 8 is a partially phantom perspective view of a combination of the main assembly of the image forming apparatus, and the fixing apparatus therefor, in the second embodiment, as seen from the front side of the main assembly, after the installation of the fixing apparatus into the main assembly.

Figure 9:
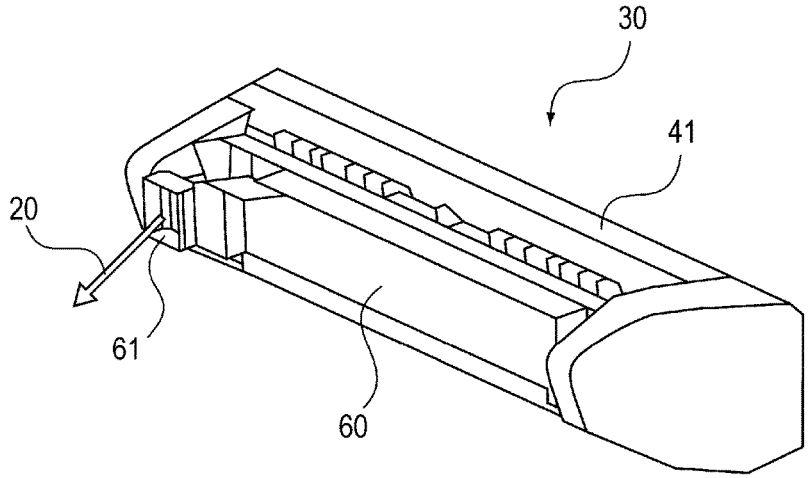
Figure 9:
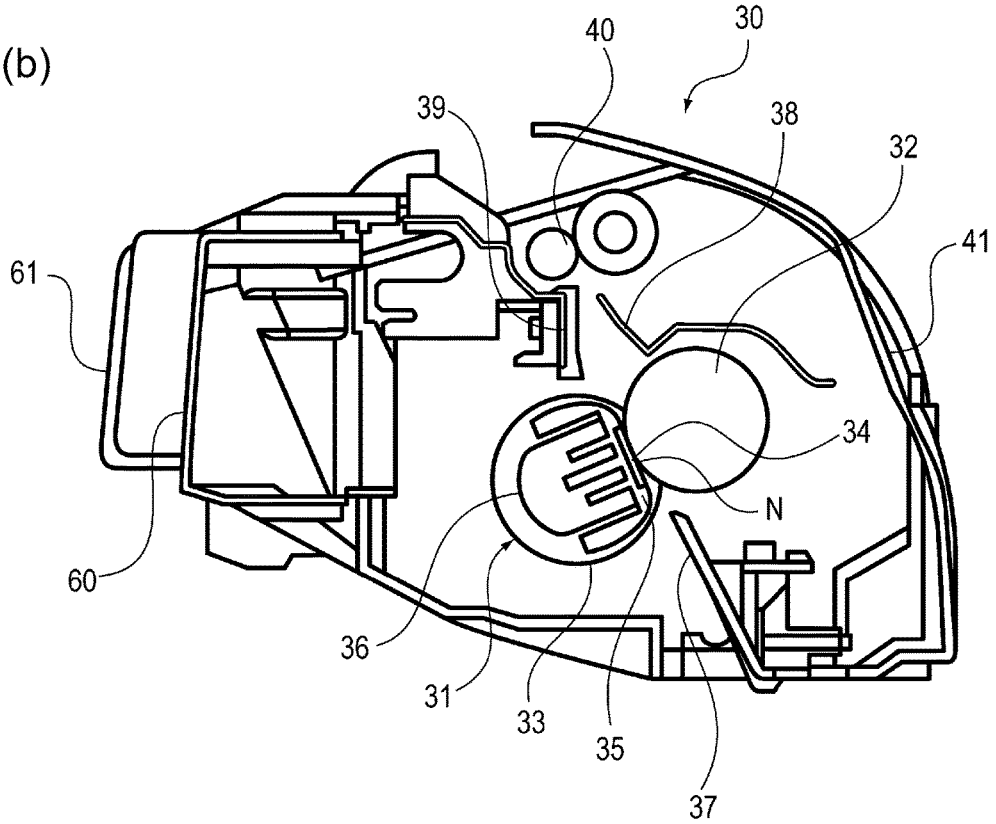

Part (a) of FIG. 9 is a perspective view of the fixing apparatus in the third embodiment of the present invention, showing the structure of the fixing apparatus. Part (b) of FIG. 9 is a sectional view of the fixing apparatus in the third embodiment, also showing the structure of the fixing apparatus.

Figure 10:
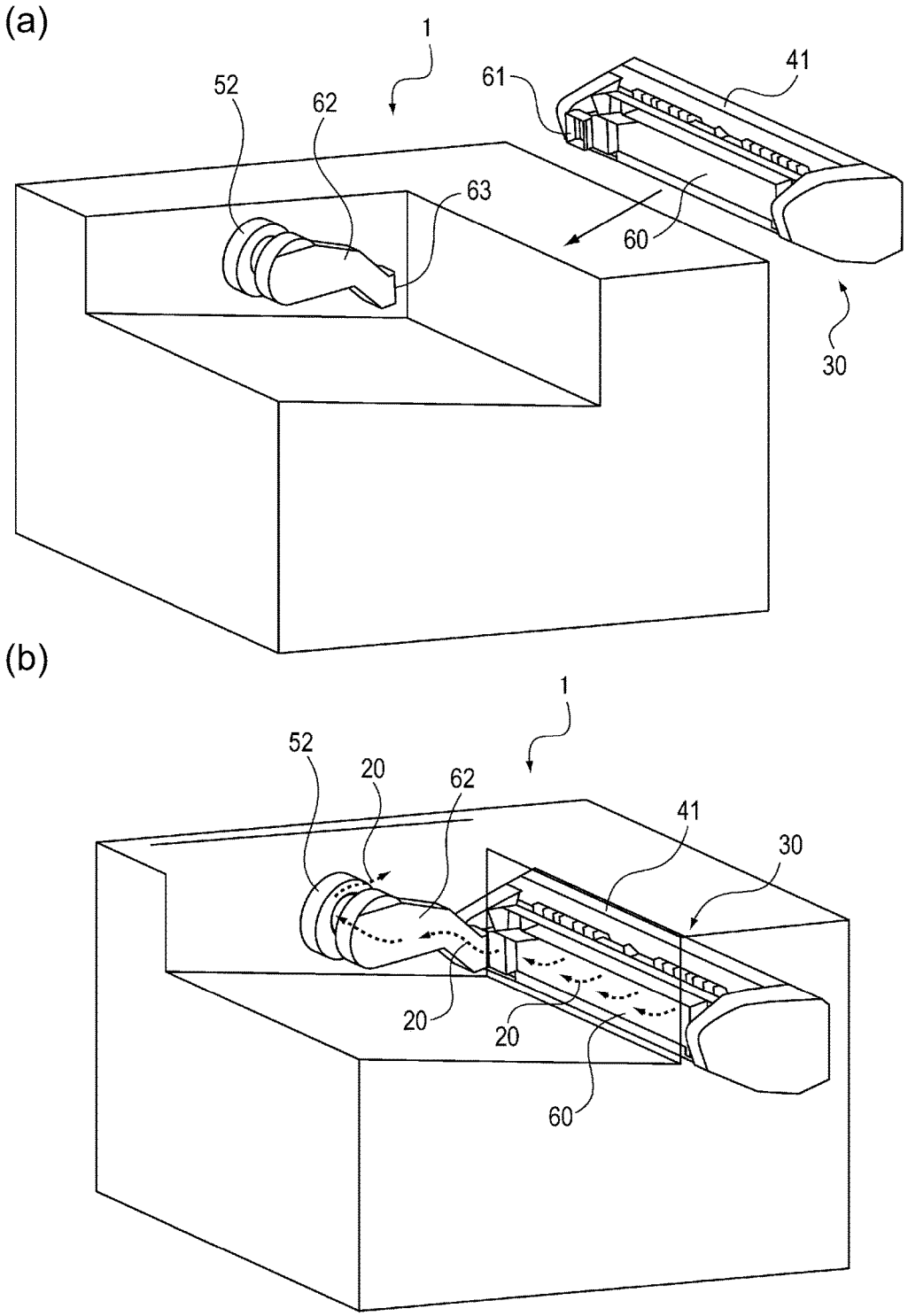

Part (a) of FIG. 10 is a partially phantom perspective view of a combination of the main assembly of the image forming apparatus in the third embodiment, and the fixing apparatus therefor, as seen from the front side of the image forming apparatus, for describing how the fixing apparatus is installed into the main assembly. Part (b) of FIG. 10 is a partially phantom perspective view of a combination of the main assembly of the image forming apparatus in the third embodiment, and the fixing apparatus therefor, as seen from the front side of the image forming apparatus, after the installation of the fixing apparatus into the main assembly.

Figure 11:
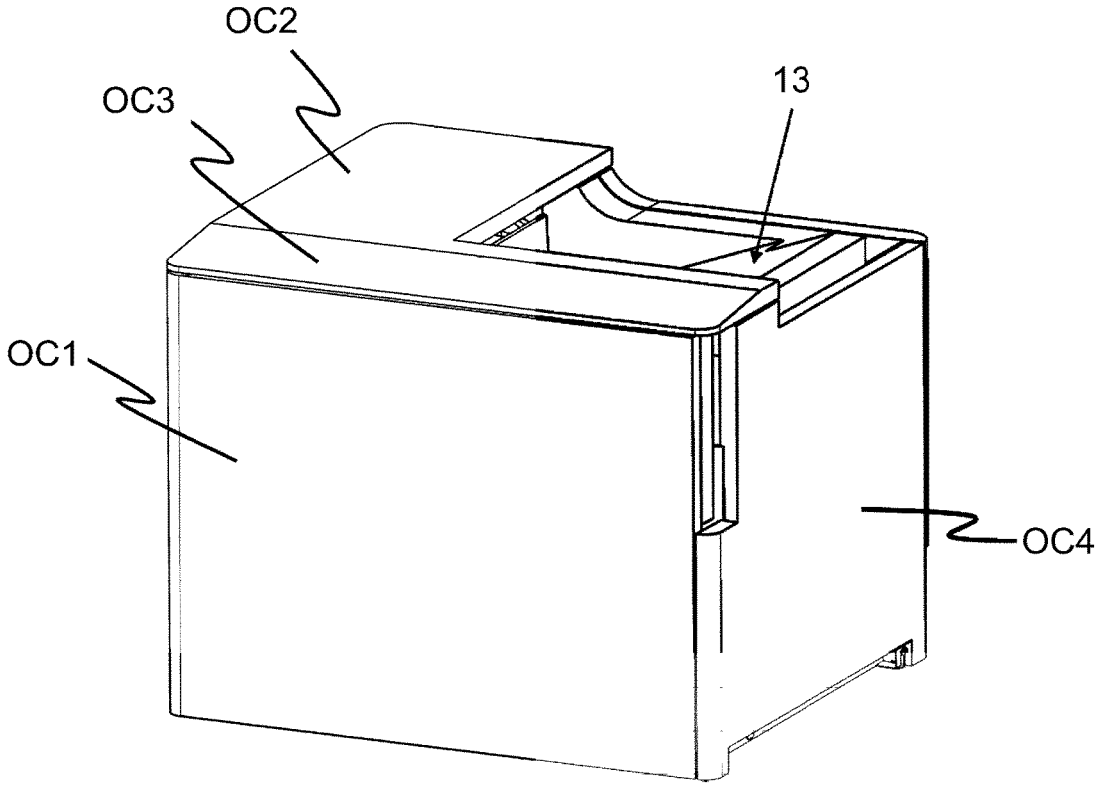

FIG. 11 is a perspective view of the image forming apparatus shown in part (a) of FIG. 5, as seen from the rear side of the image forming apparatus, that is, in the direction indicated by X in part (a) of FIG. 5.

Figure 12:
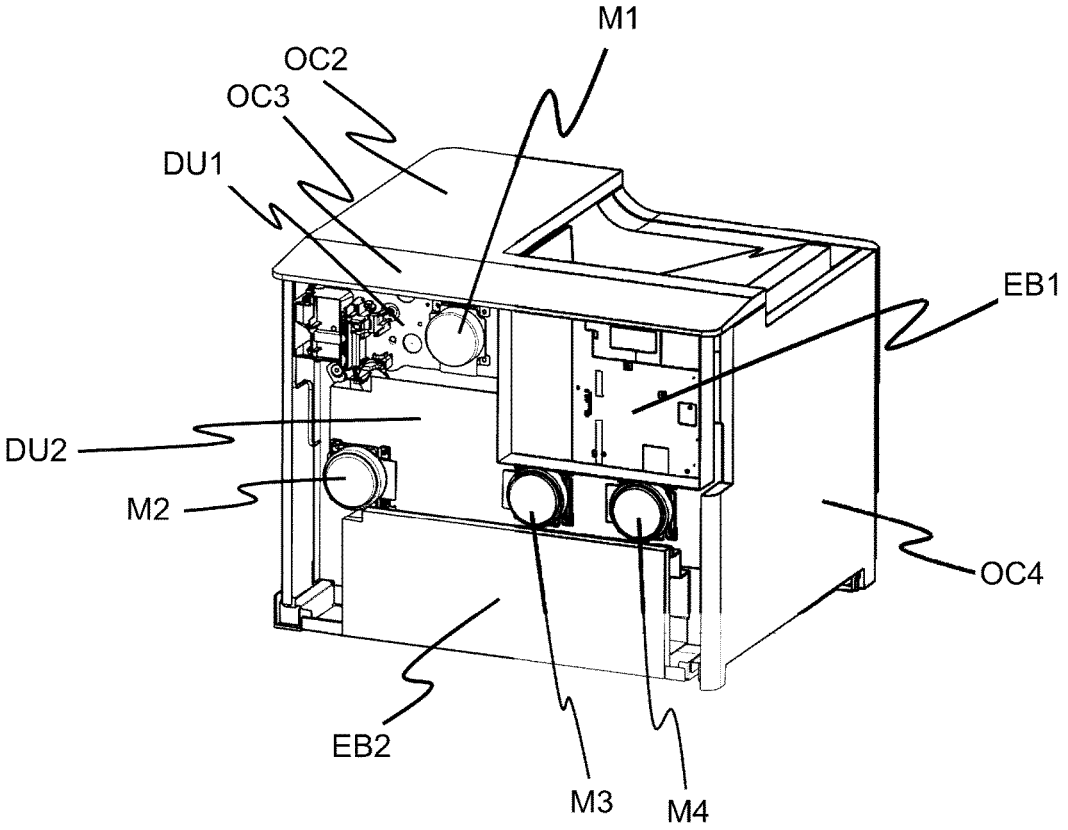

FIG. 12 is a perspective view of the main assembly of the image forming apparatus in part (a) of FIG. 5, as seen from the rear side of the image forming apparatus, that is, in the direction indicated by X in part (a) of FIG. 5, with the rear cover of the image forming apparatus removed.

Figure 13:
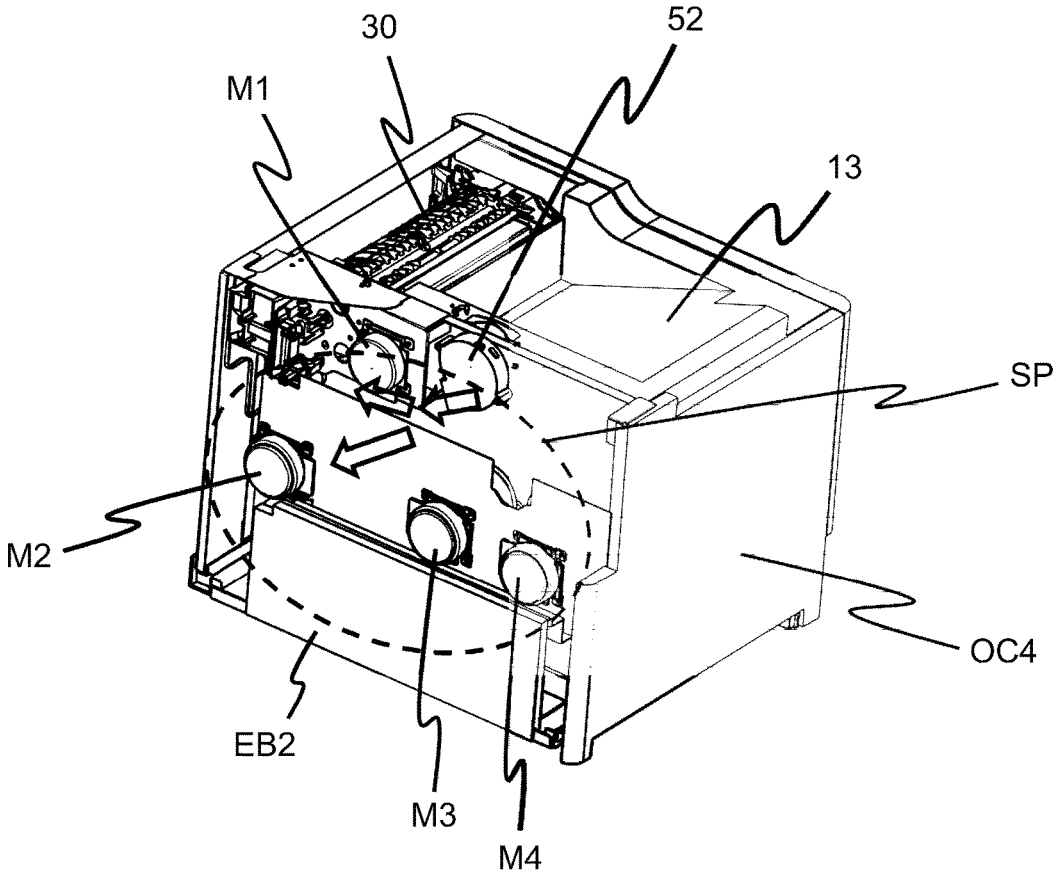

FIG. 13 is a perspective view of the main assembly of the image forming apparatus in part (a) of FIG. 5, as seen from the rear side of the image forming apparatus, that is, in the direction indicated by X in part (a) of FIG. 5, with the top and rear covers of the image forming apparatus removed.

Figure 14:
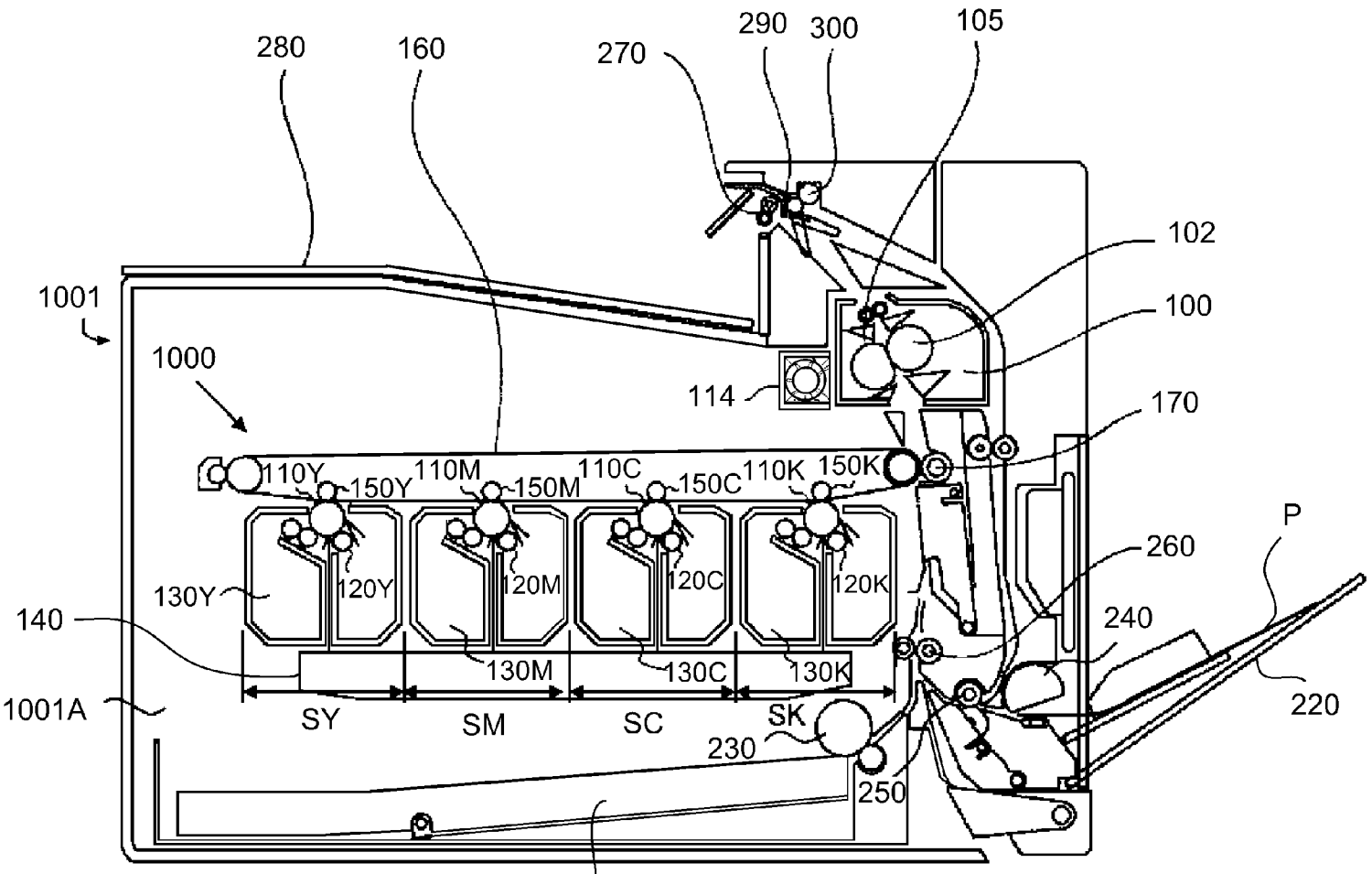

FIG. 14 is a sectional view of the image forming apparatus in the fourth embodiment of the present invention, showing the general structure of the image forming apparatus.

Figure 15:
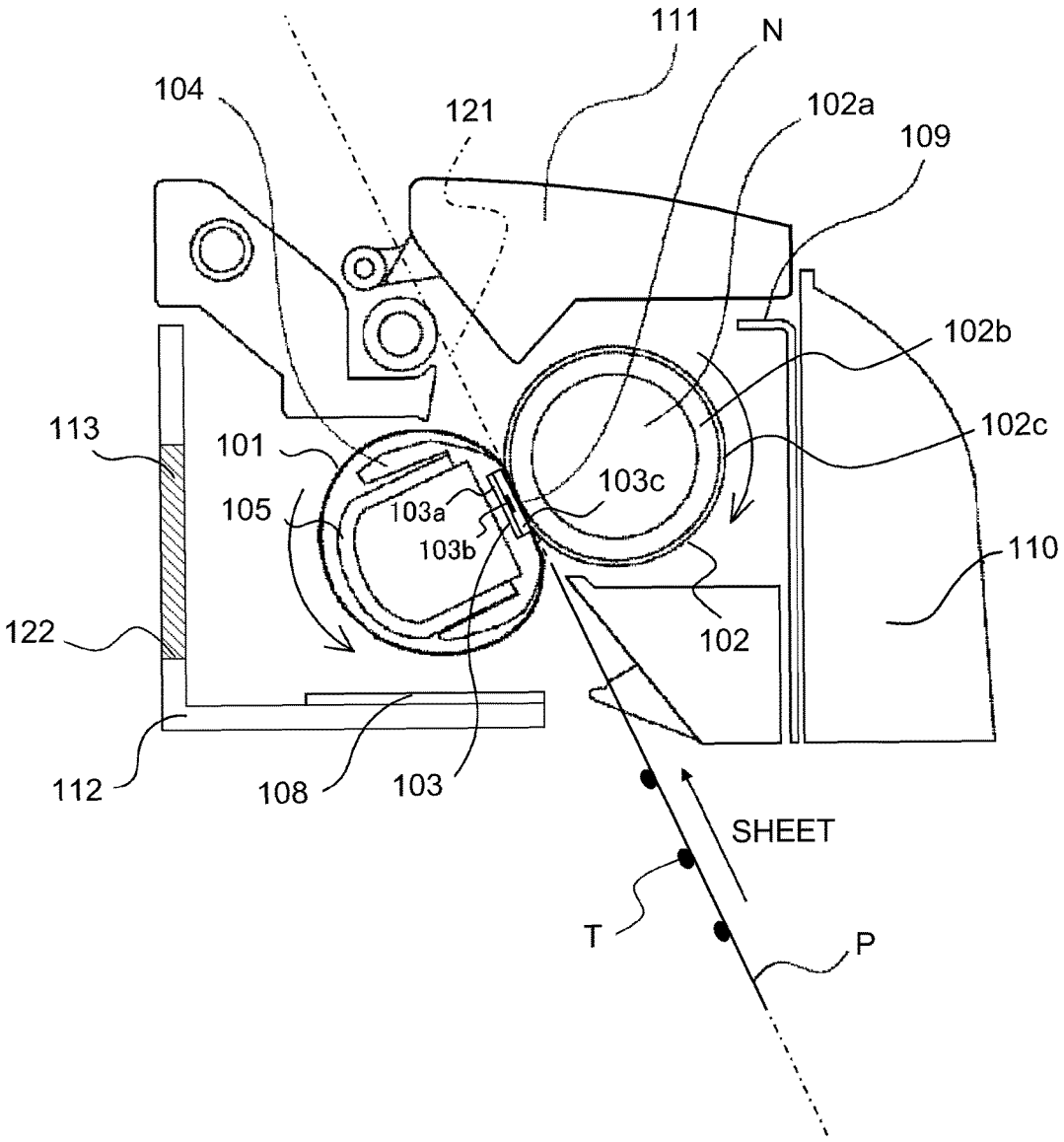

FIG. 15 is a sectional view of the fixing apparatus in the fourth embodiment, showing the general structure of the fixing apparatus.

Figure 16:
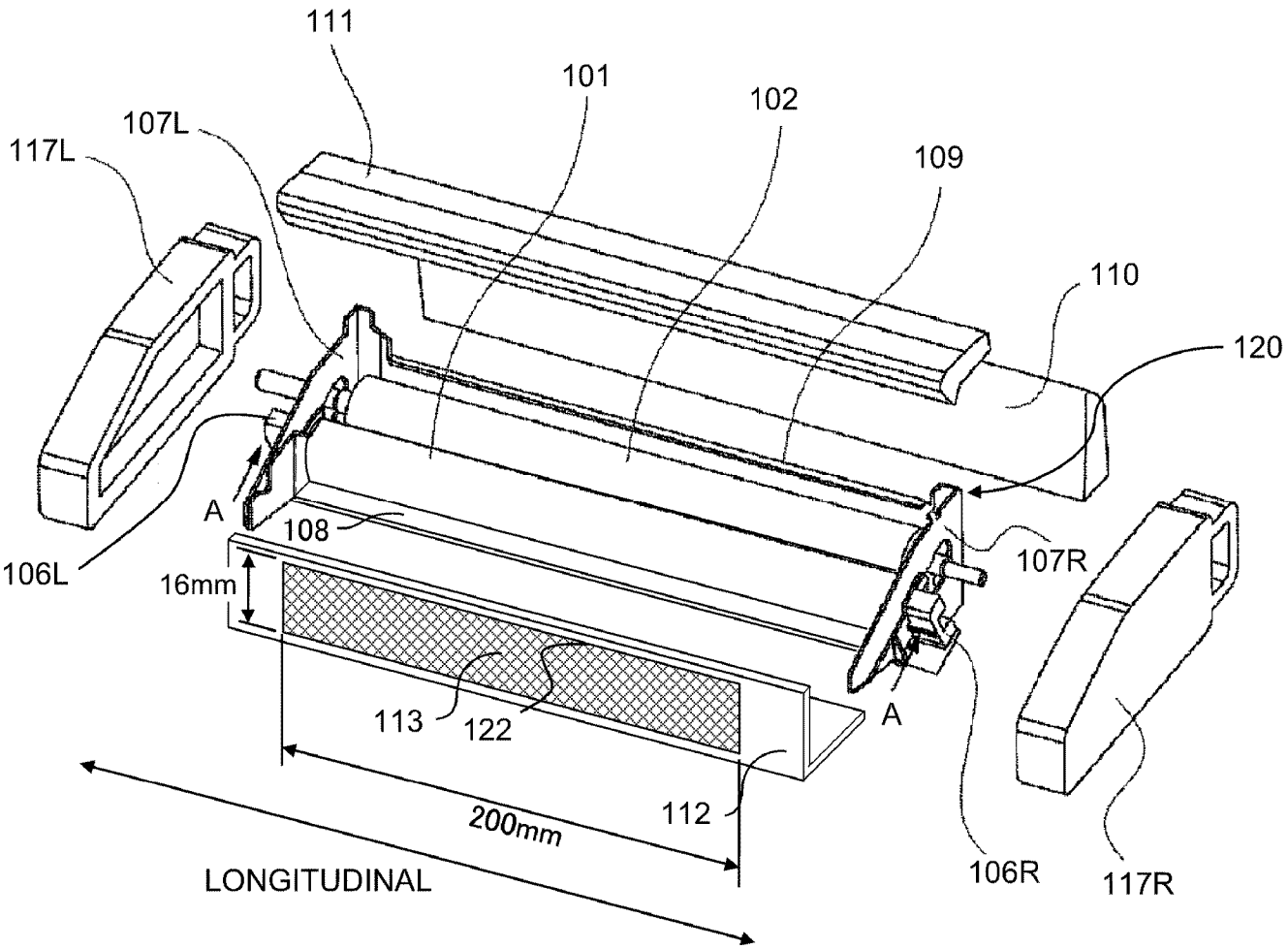

FIG. 16 is a partially exploded perspective view of the fixing apparatus in the fourth embodiment, for describing the frame and covering members of the fixing apparatus.

Figure 17:
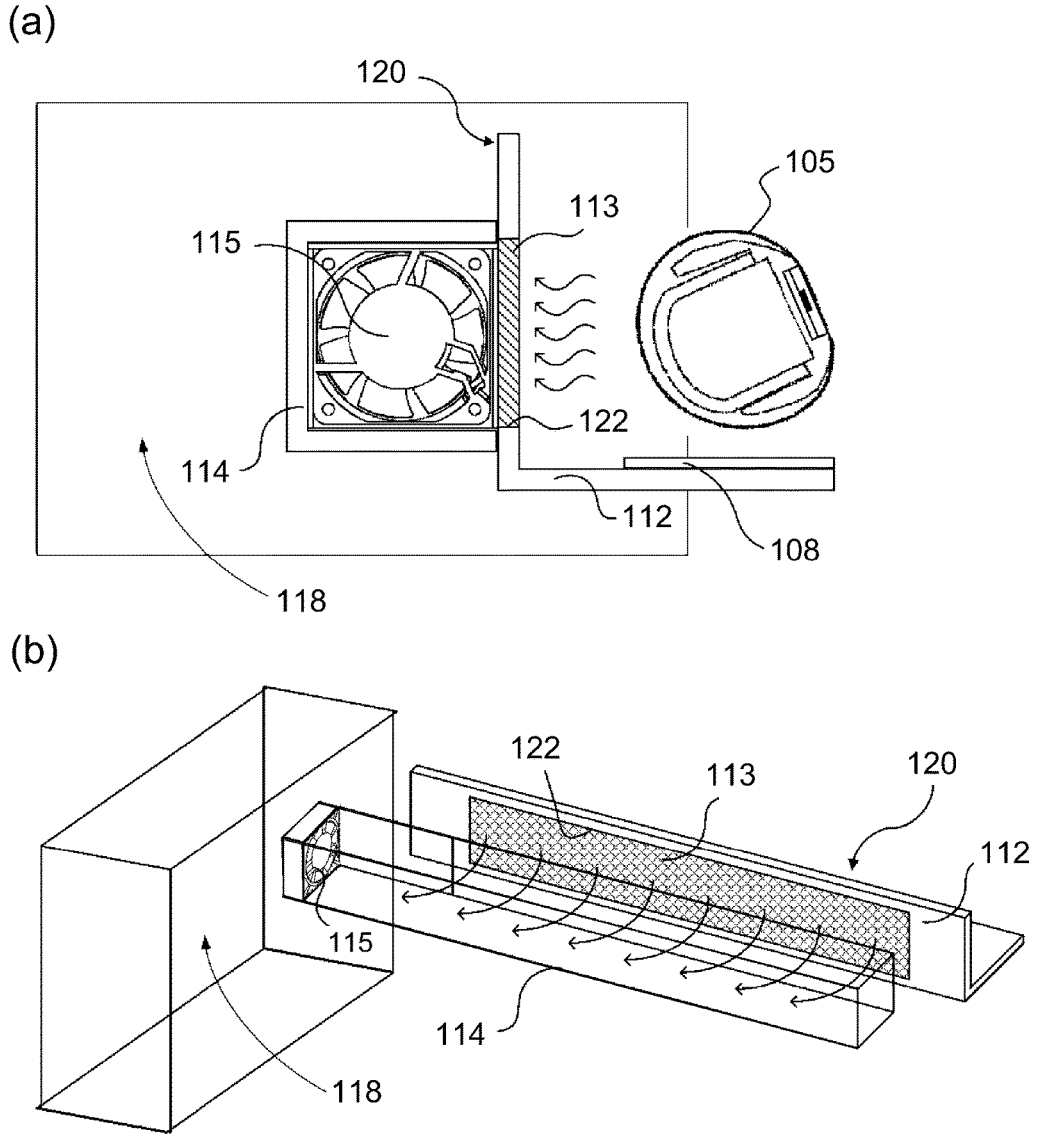

Part (a) of FIG. 17 and part (b) of FIG. 17 are illustrations of the airflow in the fixing apparatus in the fourth embodiment.

Figure 18:
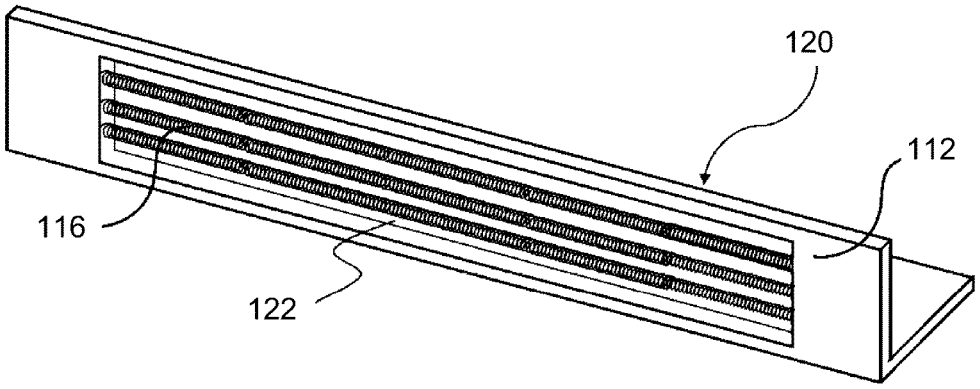

FIG. 18 is a perspective view of the front cover of the frame of the fixing apparatus of the image forming apparatus in the fifth embodiment of the present invention.

DESCRIPTION OF THE EMBODIMENTS

Embodiment 1

First, referring to FIGS. 1 to 6, the image forming apparatus in the first embodiment of the present invention is described with regard to the structure.

<Image Forming Apparatus>

Figure 1:
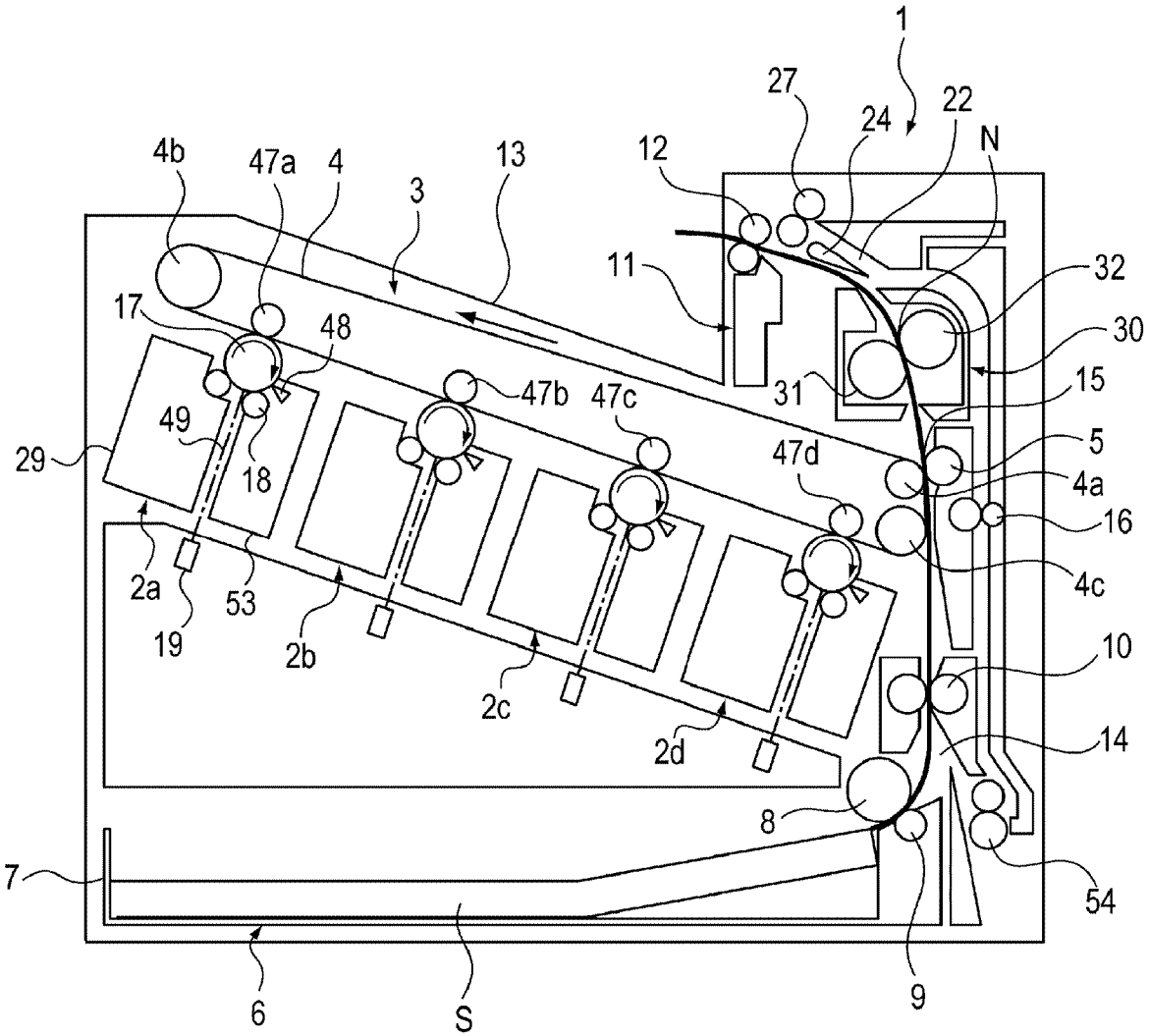
FIG. 1 is a sectional view of the image forming apparatus in the first embodiment of the present invention, showing the general structure of the image forming apparatus.

To begin with, referring to FIG. 1, the image forming apparatus 1 in this embodiment is described with regard to the structure. FIG. 1 is a sectional view of the image forming apparatus 1 in this embodiment. It is for describing the structure of the image forming apparatus 1. The image forming apparatus 1 in FIG. 1 is an image forming apparatus for forming a full-color image with the use of yellow (Y), magenta (M), cyan (C), and black (B) toners. The main assembly of the image forming apparatus 1 is structured so that four image formation units 2*a* to 2*d* for forming yellow (Y), magenta (M), cyan (C), and black (B) toner images, respectively, are removably installable in the main assembly. By the way, for convenience sake, the image formation units 2*a* to 2*d* may sometimes be described as an image formation unit 2. This abbreviation applies also to the description of other image forming processing means.

Each image formation unit 2 is provided with a photosensitive drum 17, as an image bearing member, that is rotatable in the clockwise direction with reference to FIG. 1. The image formation unit 2 is also provided with a charge roller 18, as a charging means, that is disposed in the adjacencies of the peripheral surface of the photosensitive drum 17 that rotates in the clockwise direction with reference to FIG. 1. Further, the image formation unit 2 is provided with an exposing apparatus 19, as an exposing means, and a developing apparatus 29 as a developing means.

The image forming apparatus 1 is provided with an intermediary transfer unit 3 that has an intermediary transfer belt 4 as an intermediary transferring member. The intermediary transfer belt 4 is suspended and tensioned by belt suspending-tensioning rollers 4*a* to 4*d*, so that it can be rotationally moved in the counterclockwise direction with reference to FIG. 1. The intermediary transfer unit 3 is provided with a secondary transfer roller 5, as the secondary transferring means, that is disposed in such a manner that the secondary transfer roller 5 opposes the belt suspending-tensioning roller 4*a*, with the placement of the intermediary transfer belt 4 between the two rollers 4*a* and 5. The intermediary transfer belt 4 and the secondary transfer roller 5 form a secondary transfer nip 15, and in particular, the area of contact between the outward surface of the intermediary transfer belt 4 and the peripheral surface of the secondary transfer roller 5 is the secondary transfer nip 15.

Each image formation unit 2 is provided with a primary transfer roller 47, as the primary transferring means, and the primary transfer rollers are disposed on the inward side of a loop (belt loop) formed by the intermediary transfer belt 4. Each primary transfer roller 47 is disposed so that it opposes the photosensitive drum 17. Further, each image formation unit 2 is provided with a cleaning blade 48 as a cleaning means. Moreover, the image forming apparatus 1 is provided with a fixing apparatus 30 (fixing portion) that is on the downstream side of the secondary transfer nip 15. The fixing apparatus 30 is provided with a combination of a fixation film 33 and a pressure roller 32. The combination functions as a fixing means for thermally fixing a toner image to a sheet S of recording medium.

The image forming apparatus 1 is provided with a conveying apparatus 6 that is disposed in the bottom portion of the image forming apparatus 1 to convey a sheet S of recording medium to the secondary transfer nip 15. The conveying apparatus 6 has a feed roller 8 and a separation roller 9. The feed roller 8 feeds a sheet S of recording medium into the main assembly of the image forming apparatus 1 from a recording medium feeder cassette 7 in which multiple sheets S of recording medium are storable. The separation roller 9 is a separating means. The sheets S in the sheet feeder cassette 7 are fed one by one into the main assembly of the image forming apparatus 1 by the combination of the feed roller 8 and the separation roller 9.

After each sheet S of recording medium is fed into the main assembly of the image forming apparatus 1 by the coordination of the feed roller 8 and the separation roller 9 while being separated from the rest of the sheets S in the sheet feeder cassette 7, each sheet S is conveyed further along a conveyance passage 14, until a leading edge of the sheet S bumps into the nip between a pair of registration rollers 10 that are temporarily kept stationary. As the leading edge of the sheet S bumps into the nip, the sheet S is straightened in attitude (if it is askew) by its own resiliency. Then, as the pair of registration rollers 10 is rotated with preset timing, the sheet S is conveyed to the secondary transfer nip 15 by the pair of registration rollers 10, remaining pinched by the pair of registration rollers 10.

<Image Forming Operation>

As each photosensitive drum 17 is rotated in the clockwise direction with reference to FIG. 1, and is uniformly charged by the corresponding charge roller 18 across a peripheral surface. Then, a beam 49 of laser light is projected upon the uniformly charged peripheral surface of the photosensitive drum 17, from the exposing apparatus 19 while being modulated according to the information of the image to be formed. Consequently, an electrostatic latent image is effected on the peripheral surface of the photosensitive drum 17. Then, toner is supplied to the electrostatic latent image formed on the peripheral surface of each photosensitive drum 17 from the corresponding developing apparatus 29.

As a result, the electrostatic latent image on each photosensitive drum 17 is developed into a toner image. Then, the toner images formed on the peripheral surfaces of the photosensitive drums 17, one for one, are sequentially transferred in layers (primary transfer) onto an outward surface of the intermediary transfer belt 4 by the primary transfer bias applied to each primary transfer roller 47 by an unshown primary transfer bias power source. After the completion of the primary transfer, the residual toner remaining on the peripheral surface of each photosensitive drum 17 is scraped away by the corresponding cleaning blade 48, and then, is recovered into a container 53.

Thereafter, in the secondary transfer nip 15, the secondary transfer bias that is positive in polarity is applied to the transfer roller 5 by an unshown secondary transfer bias power source. As the bias is applied, the four toner images, different in color, borne on the outward surface of the intermediary transfer belt 4 are transferred together (secondary transfer) onto a sheet S of recording medium delivered to the secondary transfer nip 15. Then, the sheet S, on which the unfixed toner images are present, are conveyed to the fixing apparatus 30.

The fixing apparatus 30 has a heating unit 31 and a pressure roller 32. The heating unit 31 is a heating member, and functions as a fixing means. The pressure roller 32 is a pressure applying means. The heating unit 31 and the pressure roller 32 are pressed against each other, forming thereby a fixation nip N between them. The sheet S of recording medium, on which the unfixed toner images are present, is conveyed through the fixation nip N while remaining pinched between the heating unit 31 and the pressure roller 32. Thus, the unfixed toner images are heated and melt. Then, as the toner images cool down, they become fixed to the sheet S. After the thermal fixation of the toner images to the sheet S, the sheet S is discharged onto a delivery tray 13 by being conveyed by a pair of discharge rollers 12 while remaining pinched by the pair of discharge rollers 12.

The image forming apparatus 1 is provided with a discharging unit 11 that comprises the pair of discharge rollers 12. Further, the discharging unit 11 is provided with a flapper 24 and a pair of reversing (or reversal conveyance) rollers 27. Part (a) of FIG. 2 is a sectional view of a combination of the discharging unit 11 and the fixing apparatus 30 in this embodiment. It is for showing how a sheet S of recording medium is discharged from the image forming apparatus 1. Parts (b) and (c) of FIG. 2 are sectional views of the combination of the discharging unit 11 and the fixing apparatus 30 of the image forming apparatus 1 in this embodiment. They are for showing how the sheet S is conveyed to a conveyance passage 22 for the two-sided printing mode.

In order to discharge a sheet S of recording medium, to which toner images have just been thermally fixed in the fixing apparatus 30, into the delivery tray 13, the flapper 24 is pivotally moved about a shaft 25 in the counterclockwise direction with reference to part (a) of FIG. 2. Thus, the sheet S is conveyed toward the pair of discharge rollers 12, and then, is conveyed further by the pair of discharge rollers 12 to a discharge passage while remaining pinched between the pair of discharge rollers 12.

Part (b) of FIG. 2 and part (c) of FIG. 2 show how a sheet S of recording medium is conveyed so that it is placed upside down to form an image on the second surface of the sheet S, after the formation of an image on the first surface of the sheet S. Referring to part (b) of FIG. 2, the flapper 24 is rotated about the shaft 25 in the clockwise direction. Thus, as the sheet S comes out of the fixing apparatus 30, it is guided toward the reversal conveyance rollers 27 by a conveyance guide 26. Then, the sheet S is conveyed to the turn-over passage 21 while remaining pinched between the pair of reversal conveyance rollers 27.

While the sheet S remains pinched between the pair of reversal conveyance rollers 27, the flapper 24, shown in part (c) of FIG. 2, is rotated about the shaft 25 in the counterclockwise direction with reference to part (c) of FIG. 2. Thus, the sheet S is reversed in conveyance direction, and is guided into the conveyance passage 22 for the two-sided printing mode.

Thereafter, the sheet S is conveyed by a pair of conveyance rollers 16 and a pair of conveyance rollers 52, with which the conveyance passage 22 for the two-sided printing mode, shown in FIG. 1, is provided, back into the conveyance passage 14. Then, it is conveyed further until its leading edge bumps into the nip between the pair of registration rollers 10 that are temporarily kept stationary. Thus, the sheet S is straightened in attitude (if it is askew) by its own resiliency. Thereafter, the pair of registration rollers 10 is rotated with preset timing, whereby the sheet S is conveyed to the secondary transfer nip 15 while remaining pinched between the pair of registration rollers 10. Then, toner images are transferred (secondary transfer) onto the second surface of the sheet S in the same manner as toner images were transferred onto the first surface of the sheet S as described above.

Then, the toner images on the second surface of the sheet S are thermally fixed to the sheet S by the fixing apparatus 30. Then, the flapper 24 is pivotally moved about the shaft 25 in the counterclockwise direction with reference to part (a) of FIG. 2. Thus, the sheet S is conveyed toward the pair of discharge rollers 12. Thereafter, the sheet is conveyed to a discharge passage 23 by the pair of discharge rollers 12 while remaining pinched between the pair of discharge rollers 12, and is discharged into the delivery tray 13.

In this embodiment, the main assembly of the image forming apparatus 1 was provided with both the pair of discharge rollers 12 for discharging a sheet S of recording medium into the delivery tray 13, and the pair of reverse conveyance rollers 27 that are reversely rotated for the two-sided printing mode. In order to eliminate the pair of discharge rollers 12, however, the main assembly may be structured so that the sheet S is discharged into the delivery tray 13 by the pair of reversal conveyance rollers 27. In a case in which the main apparatus assembly is structured so that the sheet S is discharged into the delivery tray 13 by the pair of reversal conveyance rollers 27, the sheet S can be discharged into the delivery tray 13 by rotating the pair of reversal conveyance rollers 27 in the normal direction (instead of reversely rotating) while the sheet S remains pinched between the pair of reversal conveyance rollers 27.

<Fixing Apparatus>

Next, referring to FIGS. 3 and 4, the structure of the fixing apparatus 30 that characterizes the present invention is described. FIG. 3 is a sectional view of the fixing apparatus 30 in this embodiment. FIG. 3 shows the structure of the fixing apparatus 30. FIG. 4 is a perspective view of the fixing apparatus 30 in this embodiment. FIG. 4 also shows the structure of the fixing apparatus 30.

The fixing apparatus 30 shown in FIG. 3 is a fixing means, and has the heating unit 31 and the pressure roller 32. The heating unit 31 has: the fixation film 33, that is endless, a heater 34, a film guide 35 that rotatably supports the fixation film 33, and a reinforcement member 36 that reinforces the film guide 35. The heater 34 is supported by the film guide 35.

The heating unit 31 and the pressure roller 32 are supported by an unshown frame. They are kept under a preset amount of pressure generated by an unshown pressing means, thereby forming the fixation nip N between the outward surface of the fixation film 33 and the peripheral surface of the pressure roller 32.

In the secondary transfer nip 15, the toner images borne on the outward surface of the intermediary transfer belt 4 are transferred (secondary transfer) onto a sheet S of recording medium. Then, the sheet S bearing the unfixed toner images is conveyed to the fixing apparatus 30, and is sent to the fixation nip N, with a leading edge of the sheet S being guided by a sheet entrance guide 37 positioned at the sheet entrance of the fixing apparatus 30.

In the fixation nip N, the toner images on the sheet S are heated and pressed. Thus, the toner images melt, and become fixed to the sheet S as they cool down, and then they are thermally fixed to the sheet S. Thereafter, the sheet S is conveyed to the nip formed between an uncurling roller 40 and a counterpart roller, through the part of the conveyance passage 14 that is on the downstream side of the fixation nip N, with the leading edge of the sheet S being guided by a pair of conveyance guides 38 and 39. The conveyance guide 38 is disposed on the pressure roller side of the sheet passage. The conveyance guide 39 is disposed on the heating unit side of the sheet passage.

As a sheet S of recording medium is heated and pressed in the fixation nip N, the sheet S curls. This curl of the sheet S is eliminated while the sheet S is conveyed through the aforementioned nip formed by the uncurling roller 40 and the counterpart roller. After being conveyed by the uncurling roller 40 while remaining pinched between the uncurling roller 40 and the counterpart roller, the sheet S is conveyed to a discharging unit 11 shown in FIG. 1. In terms of the direction perpendicular to the recording medium conveyance direction, the uncurling roller 40 and the counterpart roller are greater in dimension than the largest sheet S of recording medium that is usable with the image forming apparatus 1. Thus, the nip formed by the uncurling roller 40 can pinch the sheet S across the entirety of the sheet S in terms of the direction perpendicular to the sheet conveyance direction.

<Covering Members>

The pressure roller side of the fixing apparatus 30 relative to the sheet conveyance passage 14 is covered with a cover 41. Further, the heat unit side of the fixing apparatus 30 relative to the sheet conveyance passage 14, and the bottom side of the fixing apparatus 30 are covered with a cover 42 that is the covering member for covering the fixation film 33 as the fixing means.

Referring to FIG. 4, a vertical portion of the cover 42 is provided with multiple slits 43 (through holes), the length of which corresponds to the dimension of the fixation film 33 in terms of the vertical direction. Thus, the air in the fixing apparatus 30 can be exhausted through these slits 43 as indicated in FIG. 3 by arrow marks 20.

In this embodiment, on the upstream side of the fixation nip N of the fixing apparatus 30, the fixation film side of the sheet conveyance passage 14 is covered with the sheet entrance guide 37, whereas the heat unit side of the sheet conveyance passage 14 and the bottom side of the fixing apparatus 30 are covered with the cover 42. Further, on the downstream side of the fixation nip N, the sheet conveyance passage 14 is covered with the conveyance guides 38 and 38, and the pair of uncurling rollers 40. Thus, the internal space of the fixing apparatus 30 in this embodiment is virtually sealed except for where the slits 42 are present.

The sheet entrance guide 37, the cover 41, the cover 42, the conveyance guides 38 and 39, and a pair of uncurling rollers 40 (i.e., the uncurling roller 40 and the counterpart roller) of the fixing apparatus 30 make up the member for covering the combination of the fixation film 33 and the pressure roller 32 that make up the fixing means. That is, the pair of uncurling rollers 40, which are sheet conveying rotational members, make up a part of the covering member.

<Airflow in Main Assembly of Image Forming Apparatus>

Next, referring to FIGS. 5, 6 and 11 to 13, the airflow in the main assembly of the image forming apparatus 1 is described. Part (a) of FIG. 5 is a partially phantom perspective view of a combination of the main assembly of the image forming apparatus 1, and the fixing apparatus 30 therefor, in the first embodiment, as seen from the front side of the main assembly, and shows how the fixing apparatus 30 is installed into the main assembly. Part (b) of FIG. 5 is a partially phantom perspective view of a combination of the main assembly of the image forming apparatus 1, and the fixing apparatus 30 therefor, in the first embodiment, as seen from the front side of the main assembly, after the installation of the fixing apparatus 30 into the main assembly. FIG. 6 is a sectional view of the fixing apparatus 30 in the first embodiment, for describing the airflow in the fixing apparatus 30 in the first embodiment, the airflow being indicated by the arrow marks 20. FIGS. 11 to 13 are perspective views of the main assembly of the image forming apparatus 1, as seen from the rear side of the main assembly in part (a) of FIG. 5. FIG. 11 shows the state of the main assembly when the external covers OC1 to OC4 are on the image forming apparatus 1, and FIG. 12 shows the state of the main assembly after the removal of the external covers OC1 to OC4. FIG. 13 shows the state of the main assembly after the removal of the external covers OC1 to OC4, and an electrical unit (or electrical wiring board unit) EB1.

Referring to parts (a) and (b) of FIG. 5, the main assembly of the image forming apparatus 1 is provided with an air duct 50 that opposes the slits 43 (openings), shown in FIG. 3, with which the cover 42 of the fixing apparatus 30 is provided. The fixing apparatus 30 and the main assembly of the image forming apparatus 1 are structured so that the former is removably installable in the latter. Referring to part (b) of FIG. 5, as the fixing apparatus 30 is installed into the main assembly of the image forming apparatus 1, the slits 43 (openings) of the cover 42 become connected to the air duct 50. By the way, the air ducts 50 and 51, and a fan (or an air drawing fan) 52, which are shown in parts (a) and (b) of FIG. 5, are within the main assembly of the image forming apparatus 1.

One of the lengthwise ends of the air duct 50 is in connection to the corresponding lengthwise end of the air duct 51 that is in the rear end portion of the main assembly of the image forming apparatus 1. The other lengthwise end of the air duct 51 is provided with the air drawing fan 52, as an air drawing means, and is a sirocco fan. By the way, a sirocco fan is made up of a cylindrical skeletal frame, and multiple long and narrow blades attached to the cylindrical skeletal frame by their lengthwise ends. The sirocco fan generates such airflow that is perpendicular to its rotational axis relative to the cylindrical skeletal frame.

Referring to part (b) of FIG. 5, as the air drawing fan 52 (air drawing means) that is a sirocco fan is rotated, the air in the fixing apparatus 30 is drawn out of the fixing apparatus 30 through the air ducts 50 and 51 as indicated by the arrow marks 20. The air drawn out of the fixing apparatus 30 as indicated by the arrow marks 20 can be exhausted to a portion of the internal space of the main assembly of the image forming apparatus 1 that is unlikely to be adversely affected by water vapor.

FIGS. 11 to 13 are for describing a space to which air is exhausted by the air drawing fan 52. As the external cover OC1, shown in FIG. 11, is removed, the electrical unit EB1 having a controller, etc., and the electric power unit EB2, become visible in the main assembly, as well as a driving unit DR1 having a motor M1, and a driving unit DU2 having motors M2 to M4, as shown in FIG. 12. The motor M1 is the motor for driving the pressure roller 32. The motors M2 to M4 are those for driving the photosensitive drums 17, the intermediary transfer belt 4, etc.

FIG. 13 shows the state of image forming apparatus 1 after the external covers OC2 and OC3, and the electrical wiring board unit EB1 were removed from the image forming apparatus 1 while the image forming apparatus 1 was in the state shown in FIG. 12. Referring to FIG. 13, the air drawn out of the fixing apparatus 30 by the air drawing fan 52 is blown by the air drawing fan 52 into a space SP that is a part of the internal space of the image forming apparatus 1, and in which the driving units DU1 and DU2 are disposed. The air drawn out of the fixing apparatus 30, which contains moisture, sometimes appears like smoke to human eyes. If the air that appears like smoke comes out of the image forming apparatus 1, it is possible that a user will think that the image forming apparatus 1 is having a problem. In this embodiment, therefore, in order to prevent a user from erroneously determining that the image forming apparatus 1 is having a problem, the image forming apparatus 1 is structured so that the air in the fixing apparatus 30 is exhausted into the internal space of the image forming apparatus 1, instead of being exhausted out of the image forming apparatus 1. More concretely, in order to prevent a sheet S of recording medium from being dampened while it is being conveyed through the image forming apparatus 1, the image forming apparatus 1 is structured so that the air in the fixing apparatus 30 is exhausted by the air drawing fan 52 into a space through which a sheet S of recording medium does not move, instead of a space through which the sheet S moves. Further, in order to facilitate the air exhausted from the fixing apparatus 30 by the air drawing fan 52 to dry, the image forming apparatus 1 is structured so that the air in the fixing apparatus 30 is exhausted by the air drawing fan 52 into a part of the internal space of the image forming apparatus 1 in which the heat from the motors M1 to M4 is likely to linger, and in which the driving units DU1 and DU2 are disposed.

Moreover, in this embodiment, the image forming apparatus 1 is structured so that, as the air in the fixing apparatus 30 is exhausted by the air drawing fan 52, the air is directed toward the motors M1 and M2, as indicated by arrow marks in FIG. 13. The motors M1 and M2 are disposed closer to the fixing apparatus 30 than the motors M3 and M4. Therefore, the motors M1 and M2 are more likely to be exposed to the heat from the fixing apparatus 30 than the motors M3 and M4. In this embodiment, however, the image forming apparatus 1 is structured so that the cooling of the motors M1 and M2 is facilitated by the air exhausted by the air drawing fan 52 from the fixing apparatus 30. By the way, in this embodiment, in the space SP of the image forming apparatus 1, the electrical unit EB2 and the electrical power unit EB2 are also disposed, in addition to the driving units DU1 and DU2.

Referring to FIG. 6, as a sheet S of recording medium, such as paper, is heated in the fixation nip N, the moisture contained in the sheet S evaporates into water vapor. The space in the immediate downstream adjacencies of the fixation nip N is covered by the uncurling rollers 40 and the conveyance guides 38 and 39. The water vapor generated in the fixation nip N is, therefore, guided by the airflow indicated by the arrow marks 20 in part (b) of FIG. 5, through the slits 43 with which the cover 42 is provided, and the air ducts 50 and 51, and then, is exhausted into the portion (space SP) in the image forming apparatus 1 that is unlikely to be adversely affected by the water vapor. Thus, it can be prevented that water droplets adhere to the conveyance roller shafts 40 and the conveyance guides 38 and 39 in the image forming apparatus 1.

Further, the internal space of the fixing apparatus 30 is covered with the entrance guide 37, the covers 41 and 42, the conveyance guides 38 and 39, and the uncurling rollers 40. That is, the fixing apparatus 30 is roughly sealed, although, admittedly, the cover 42 is provided with the slits 43. Thus, the water vapor generated in the fixation nip N is drawn out of the fixing apparatus 30 through the slits 43, which are the only openings which the fixing apparatus 30 has in loose terms. After being exhausted through the slits 43, the water vapor is exhausted through the air ducts 50 and 51, into the portion of the internal space of the image forming apparatus 1 that is unlikely to be adversely affected by the water vapor.

Therefore, it is possible to prevent the problem that water droplets adhere to the pressure roller 32, the uncurling rollers 40, and the conveyance guides 38 and 39, which are on the downstream side of the fixation nip N. Moreover, it becomes possible to prevent the problems that a sheet S of recording medium becomes jammed due to slipping that occurs between the pressure roller 32 and the fixation film 33, and/or between the pressure roller 32 and the sheet S, the image forming apparatus 1 outputs unsatisfactory images, and/or the water droplets on the pressure roller 32 cause the image forming apparatus 1 to output unsatisfactory images. The number, the positioning, etc., of the slits 43, with which the cover 42 is provided, is optional. That is, this embodiment is not intended to limit the present invention in scope in terms of the structure of the image forming apparatus 1.

The portion of the internal space of the fixing apparatus 30 that is in the immediate downstream adjacencies of the fixation nip N is covered with the uncurling rollers 40, the conveyance guides 38 and 39, and the covers 41 and 42, which collectively function as covering members. That is, this portion of the internal space of the fixing apparatus 30 is almost entirely sealed, although, admittedly, the cover 42 (covering member) is provided with the slits 43 (openings). Thus, the water vapor generated from the moisture contained in a sheet S of recording medium, such as a sheet of paper, is made to evaporate during the thermal fixation process that occurs in the fixation nip N, and can be efficiently exhausted out of the fixing apparatus 30 through the slits 43.

That is, this embodiment can prevent the problem that the water droplets adhere to the peripheral surface of the pressure roller 32. Therefore, the embodiment of the invention can prevent the problem that the fixation film 33 and the sheet S of recording medium are made to slip on the peripheral surface of the pressure roller 32 due to the water droplets on the peripheral surface of the pressure roller 32. Further, the embodiment of the invention can prevent the water droplets from adhering to the conveyance guides 38 and 39 that are in the adjacencies of the fixation nip N, and to the uncurling rollers 40 (conveyance rollers) that are on the downstream side of the fixation nip N. Therefore, the embodiment of the invention can prevent the problem that the image forming apparatus 1 is made to output unsatisfactory images due to the water droplets on the conveyance guides 38 and 39 on and the uncurling rollers 40. That is, the embodiment of the invention can efficiently exhaust the water vapor that is in the adjacencies of the fixation nip N, from the fixing apparatus 30 in order to prevent the jamming of a sheet S of recording medium that is attributable to the slipping of the fixation film 33 and/or the sheet S on the peripheral surface of the pressure roller 32. Further, the embodiment of the invention can prevent the problem that the image forming apparatus 1 is made to output unsatisfactory images due to the water droplets on the peripheral surface of the pressure roller 32.

Embodiment 2

Next, referring to FIGS. 7 and 8, the image forming apparatus 1 in the second embodiment of the present invention is described with respect to the structure. By the way, the members of the image forming apparatus 1 in this embodiment that are the same in structure as the counterparts in the first embodiment are given the same referential codes as those given to the counterparts, and are not described. Further, if a given member of the image forming apparatus 1 in this embodiment is different in referential code from the counterpart in the first embodiment, but it is the same in structure as the counterpart, it also is not described. FIG. 7 is a perspective view of the fixing apparatus 30 in this embodiment. FIG. 7 shows the structure of the fixing apparatus 30. The fixing apparatus 30 in this embodiment is similar in structure to the fixing apparatus 30 in the first embodiment, except that the fixing apparatus 30 of the second embodiment employs a cover 44 (covering member) shown in FIG. 7, instead of the cover 42 (covering member) in the first embodiment. Thus, the sectional view of the fixing apparatus 30 in this embodiment is roughly the same as that of the fixing apparatus 30 in the first embodiment, shown in FIG. 3. Therefore, the portions of the fixing apparatus 30 in this embodiment, the descriptions of which are the same as the counterparts in the first embodiment, are not described.

With reference to the recording medium conveyance passage 14, the pressure roller side of the fixing apparatus 30 in this embodiment is covered with the cover 41, and the heating unit side of the fixing apparatus 30 is covered with the cover 44. Further, the bottom side of the fixing apparatus 30 also is covered with the cover 44. Referring to FIG. 7, the cover 44 is provided with slits 45 (through holes), like the slits 43 shown in FIG. 3, that oppose the fixation film 33.

Also, in the case of the fixing apparatus 30 in this embodiment, an upstream side relative to the fixation nip N with reference to the recording medium conveyance passage 14 is covered with the sheet entrance guide 37. Further, the pressure roller side is covered with the cover 41, and the heating unit side is covered with the cover 44, shown in FIG. 7. Further, the bottom side of the fixing apparatus 30 also is covered with the cover 44. Moreover, with reference to the fixation nip N, the downstream side of the fixing apparatus 30 is covered with a combination of the conveyance guides 38 and 39 and the uncurling rollers 40 on the top side.

In this embodiment, the fixing apparatus 30 is structured so that the sheet entrance guide 37, the cover 41, the cover 44, the conveyance guides 38 and 39, and the uncurling rollers 40 function also as the covering member for covering the fixation film 33 and the pressure roller 32 that make up a fixing means. Further, the fixing apparatus 30 is structured so that the conveyance guides 38 and 39 that guide a sheet S of recording medium as the sheet S is conveyed function as a part of the covering member. Further, the fixing apparatus 30 is structured so that the uncurling rollers 40 that convey the sheet S function as a part of the covering member. Thus, the internal space of the fixing apparatus 30 in this embodiment is almost entirely sealed, except for the area having the slits 45 (through holes) with which the cover 44 is provided.

<Airflow in Main Assembly of Image Forming Apparatus>

Next, referring to FIG. 8, the airflow, indicated by the arrow marks 20, in the image forming apparatus 1 is described. Part (a) of FIG. 8 is a perspective view of a combination of the main assembly of the image forming apparatus 1, and the fixing apparatus 30 for the image forming apparatus 1, as seen from the front side of the image forming apparatus 1. Part (a) of FIG. 8 shows how the fixing apparatus 30 is installed into the main assembly of the image forming apparatus 1. Part (b) of FIG. 8 is a perspective view of the combination of the main assembly of the image forming apparatus 1 and the fixing apparatus 30 of the image forming apparatus 1, as seen from the front side of the image forming apparatus 1, after the installation of the fixing apparatus 30 in the main assembly of the image forming apparatus 1.

Referring to part (a) of FIG. 8, the main assembly of the image forming apparatus 1 in this embodiment is provided with a pair of air drawing fans 46 that are disposed so that they oppose the slits 45 (openings), with which the cover 44 (covering member) of the fixing apparatus 30 is provided. The air drawing fans 46 are air drawing means for drawing air out of the fixing apparatus 30 through the slits 45 (openings) as indicated by the arrow marks 20. The air drawing fans 46 in this embodiment are axial-flow fans, an axial-flow fan being a fan that generates airflow in a direction that is parallel to a rotational axis of the axial-flow fan.

The fixing apparatus 30 in this embodiment also is removably installable in the main assembly of the image forming apparatus 1. Referring to part (b) of FIG. 8, when the fixing apparatus 30 is in the main assembly of the image forming apparatus 1, the air in the fixing apparatus 30 can be drawn out of the fixing apparatus 30 through the slits 45 (openings) of the cover 44, by the rotation of the air drawing fans 46, as indicated by the arrow marks 20. After being drawn out of the fixing apparatus 30, the air is efficiently discharged into the portion of the internal space of the main assembly of the image forming apparatus 1 that is unlikely to be adversely affected by water vapor.

The main assembly of the image forming apparatus 1 is provided with a pair of containers 28 as drains that are on the exhaust side of the air drawing fans 46, one for one. As the air in the fixing apparatus 30 that contains water vapor is exhausted from the fixing apparatus 30 by the pair of air drawing fans 46, as indicated by the arrow marks 20, the air runs into the wall of the containers 28 (drains). A part of the air is discharged into the portion of the internal space of the main assembly of the image forming apparatus 1 that is unlikely to be adversely affected by water vapor. The water droplets that generate as the water vapor cools down are stored in the containers 28 (drains).

Regarding the internal space of the fixing apparatus 30, on the downstream side with reference to the fixation nip N, the top side of the conveyance passage 14 is covered with the uncurling rollers 40 and the conveyance guides 38 and 39. Thus, as the water vapor is generated in the fixation nip N of the fixing apparatus 30, the water vapor is drawn, along with the air in the fixing apparatus 30, out of the fixing apparatus 30 through the slits 45 of the cover 44, and discharged into the portion of the internal space of the main assembly of the image forming apparatus 1 that is unlikely to be adversely affected by the water vapor, as indicated by the arrow marks 20. It is possible, therefore, to prevent the problem that the water droplets adhere to the uncurling rollers 40 (conveyance rollers) and to the conveyance guides 38 and 39.

Further, the internal space of the fixing apparatus 30 is almost entirely sealed by the above-described various covering members. As the water vapor is generated in the fixation nip N, the water vapor can, therefore, be efficiently drawn out by the air drawing fans 46, through the slits 45 (openings) of the cover 45 that are the only openings of the fixing apparatus 30, and discharged into the portion of the internal space of the main assembly of the image forming apparatus 1 that is unlikely to be adversely affected by the water vapor.

It is possible, therefore, to prevent the problem that water droplets adhere to the pressure roller 32, and also, to the uncurling rollers 40 and to the conveyance guides 38 and 39 that are on the downstream side of the fixation nip N. Further, it is possible to prevent the problems that a sheet S of recording medium becomes jammed due to the slipping of the fixation film 33 and/or the sheet S on the pressure roller 32, the slipping causing the image forming apparatus 1 to output unsatisfactory images, and the water droplets making the images unsatisfactory. The image forming apparatus 1 and the fixing apparatus 30 therefor, in this embodiment, are similar in structure to those in the first embodiment, and are similar in effects as those in the first embodiment.

Embodiment 3

Next, referring to FIGS. 9 and 10, the image forming apparatus 1 in the third embodiment of the present invention is described with respect to the structure. By the way, the members of the image forming apparatus 1 in this embodiment that are similar in structure to the counterparts in the preceding embodiments are given the same referential codes as those given to the counterparts, and are not described. Further, if a given member of the image forming apparatus 1 in this embodiment is different in referential code from the counterpart, but is the same in structure as the counterpart, it is given the same name as that given to the counterpart, and is not described. Part (a) of FIG. 9 is a perspective view of the fixing apparatus 30 in the third embodiment. Part (a) of FIG. 9 shows the structure of the fixing apparatus 30. Part (b) of FIG. 9 is a sectional view of the fixing apparatus 30 in the third embodiment. Part (b) of FIG. 9 shows the structure of the fixing apparatus 30. Part (a) of FIG. 10 is a perspective view of a combination of the main assembly of the image forming apparatus 1 and the fixing apparatus 30 in this embodiment, as seen from the front side of the image forming apparatus 1. Part (a) of FIG. 10 shows how the fixing apparatus 30 is installed into the main assembly of the image forming apparatus 1. Part (b) of FIG. 10 is a perspective view of the combination of the main assembly of the image forming apparatus 1 and the fixing apparatus 30 therefor in the third embodiment, as seen from the front side of the image forming apparatus 1, after the installation of the fixing apparatus 30 into the main assembly of the image forming apparatus 1.

The fixing apparatus 30 in this embodiment is roughly the same in structure as the fixing apparatus 30 in the first embodiment, except that the fixing apparatus 30 of the third embodiment has a cover 60 shown in part (b) of FIG. 9 instead of the cover 42 (covering member), shown in FIG. 3, in the first embodiment. The members of the fixing apparatus 30 other than the cover 60 (covering member) are, therefore, not described, in order not to repeat the same descriptions. In the case of the fixing apparatus 30 in this embodiment, the pressure roller side of the recording medium passage 14 is covered with the cover 41, whereas the heating unit side of the recording medium passage 14, and the bottom side of the fixing apparatus 30, are covered with the cover 60.

The fixing apparatus 30 in this embodiment is structured so that the sheet entrance guide 37, the cover 41, the cover 60, the conveyance guides 38 and 39, and the uncurling rollers 40 function as the covering member for covering the combination of the fixation film 33 and the pressure roller 32 that make up a fixing means, and also, so that the recording medium conveyance guides 38 and 39 function as a part of the covering member. Further, the fixing apparatus 30 is structured so that the uncurling rollers 40, which are rotational conveying members for conveying a sheet S of recording medium, function also as a part of the covering member. With the fixing apparatus 30 being structured as described above, the internal space of the fixing apparatus 30 in this embodiment also remains almost entirely sealed, except where an opening 61, with which the cover 60 is provided, is.

Referring to part (b) of FIG. 9, the cover 60 in this embodiment is disposed so that it extends from one of the lengthwise ends of the fixation film 33 to the other, with the presence of a preset amount of space between itself and the fixation film 33. Referring to part (a) of FIG. 9, one of the lengthwise ends of the cover 60 is provided with the opening 61 that becomes connected to the opening 63, shown in parts (a) and (b) of FIG. 10, provided at one end of the air duct 62 of the main assembly of the image forming apparatus 1, as the fixing apparatus 30 is installed into the main assembly of the image forming apparatus 1. The other lengthwise end of the air duct 62 is provided with the air drawing fan 52, which is a sirocco fan as an air drawing means. The air drawing fan 52 (drawing means) draws the air in the fixing apparatus 30 out of the fixing apparatus 30 through opening 61 (opening) with which the cover 60 is provided, by way of the air duct 62.

Referring to part (b) of FIG. 9, in the internal space of the fixing apparatus 30 in this embodiment, the immediately upstream portion of the recording medium conveyance passage 14 relative to the fixation nip N is covered with the sheet entrance guide 37, whereas the pressure roller side of the recording medium conveyance passage 14 is covered with the cover 41. Further, the opposite side of the pressure roller 32 from the recording medium conveyance passage 14 is covered with the cover 41, whereas the opposite side of the heating unit 31 from the recording medium conveyance passage 14, and the bottom side of the fixing apparatus 30, are covered with the cover 60. Further, the top side of the downstream portion in terms of the direction in which a sheet S of recording medium is conveyed is covered with the conveyance guides 38 and 39 and the uncurling rollers 40. Thus, the internal space of the fixing apparatus 30 is almost completely sealed except where the opening 61, with which one of the lengthwise ends of the cover 60 is provided, is present.

<Airflow in Main Assembly of the Image Forming Apparatus>

Next, referring to part (a) of FIG. 10, the airflow in the main assembly of the image forming apparatus 1 in this embodiment is described. Referring to part (a) of FIG. 10, the main assembly of the image forming apparatus 1 is provided with the air duct 62 having that opening 63 that becomes separably connected to the opening 61, with which one of the lengthwise ends of the cover 60 of the fixing apparatus 30 is provided, as the fixing apparatus 30 is installed into the main assembly of the image forming apparatus 1.

The image forming apparatus 1 in this embodiment also is structured so that the fixing apparatus 30 is removably installable in the main assembly of the image forming apparatus 1. Referring to part (b) of FIG. 10, as the fixing apparatus 30 is installed into the main assembly of the image forming apparatus 1, the opening 61 with which one of the lengthwise ends of the cover 60 is provided becomes connected to the opening 63 with which one end of the air duct 62 is provided. That is, the cover 60 and the air duct 62 are integrated into an air duct.

The other end of the air duct 62 is connected to the air drawing fan 52, which is a sirocco fan. As the air drawing fan 52 is rotated, the air in the fixing apparatus 30 is drawn out of the fixing apparatus 30 by the air drawing fan 52 through the air duct 62, and then, the air efficiently discharged into the portion of the internal space of the main assembly of the image forming apparatus 1 that is unlikely to be adversely affected by the water vapor.

Regarding the internal space of the fixing apparatus 30 in this embodiment, the downstream portion of the fixing apparatus 30, in terms of the direction in which a sheet S of recording medium is conveyed through the conveyance passage 14, is covered with the uncurling rollers 40 and the conveyance guides 38 and 39. Thus, as water vapor is generated in the fixation nip N, the water vapor is exhausted into the portion of the internal space of the main assembly of the image forming apparatus 1 that is unlikely to be adversely affected by the water vapor, by the airflow indicated by the arrow marks 20. It is possible, therefore, to prevent the problem that water droplets adhere to the uncurling rollers 40 (conveyance roller shaft) and to the conveyance guides 38 and 39.

Further, the internal space of the fixing apparatus 30 is almost entirely sealed. Therefore, as the water vapor is generated in the fixation nip N, the water vapor can be drawn out of the fixing apparatus 30 by the air drawing fan 52, and then, the water vapor discharged into the portion of the internal space of the main assembly of the image forming apparatus 1 that is unlikely to be adversely affected by the water vapor, through the opening 61 of the cover 60 that is practically the only opening of the fixing apparatus 30.

It is possible, therefore, to prevent the problem that water droplets adhere to the pressure roller 32, and also, to the uncurling rollers 40 and to the conveyance guides 38 and 39 that are on the downstream side of the fixation nip N. Further, it is possible to prevent the problem that the slipping of the fixation film 33 and/or a sheet S of recording medium on the pressure roller 32 causes paper jam and/or formation of unsatisfactory images, as well as the problem that the water droplets cause the image forming apparatus 1 to output unsatisfactory images. Otherwise, the image forming apparatus 1 in this embodiment is the same in structure and effects as those in the preceding embodiments.

Next, other embodiments of the present invention are described. By the way, embodiments 4 and 5, which will be described next, are the cases in which the present invention was applied to an image forming apparatus 1 to efficiently capture wax vapor that is generated from such toner that contains wax.

Embodiment 4

<Image Forming Apparatus 1001>

Referring to FIG. 14, the image forming apparatus 1001 in the fourth embodiment of the present invention is described. FIG. 14 is a schematic sectional view of the image forming apparatus 1001 (full-color printer) in this embodiment that employs electrophotographic image formation technologies. FIG. 14 shows the general structure of the image forming apparatus 1001.

The image forming apparatus 1001 has an image forming portion 1000 that forms an image on a sheet P of recording medium with the use of such toner that contains wax. The image forming portion 1000 has four image forming stations SY, SM, SC, and SK that form yellow, magenta, cyan, and black images, respectively. The four image forming stations SY, SM, SC, and SK have photosensitive drums 110Y, 110M, 110C, and 110K, charging members 120Y, 120M, 120C, and 120K, and developing devices 130Y, 130M, 130C, and 130K, respectively. Further, the image forming portion 1000 has: a laser scanner 140, transferring members 150Y, 150M, 150C, and 150K, a belt 160, onto which toner images are transferred from the photosensitive drums 110Y, 110M, 110C, and 110K by the transferring members 150Y, 150M, 150C, and 150K, and which bears and conveys the transferred images, and a secondary transferring member 170 that transfers the toner images from the belt 160 onto a sheet P of recording medium. The operation of the above-described image forming portion 1000 is well known, and, therefore, a detailed description is not given here.

The sheets P of recording medium (unshown) stored in a cassette 210 in a main assembly 1001A of the image forming apparatus 1001 (hereafter will be referred to as image forming apparatus main assembly 1001A) are delivered one by one to a roller 260 by the rotation of a roller 230, or the sheet P of recording medium set in a manual feeder tray 220, with which the image forming apparatus main assembly 1001A is provided, are delivered to the roller 260 by the rotation of a roller 240, by way of a roller 250. Then, the sheet P is conveyed by the rotation of the roller 240 to the secondary transfer nip formed by a combination of the belt 160 and the secondary transferring member 170. After the toner images are transferred onto the sheet P in the secondary transferring portion, the sheet P is sent to a fixing apparatus 100 as a fixing portion, in which the toner images are thermally fixed to the sheet P. After the sheet P is moved out of the fixing apparatus 100, the sheet P is moved past a flapper 290, and is discharged into a delivery tray 280 by the rotation of a pair of discharge rollers 270.

The printing operation described above is the one that is carried out by the image forming apparatus 1001 when the image forming apparatus 1001 is in the one-sided printing mode.

When the image forming apparatus 1001 is in the two-sided printing mode, the image forming apparatus 1001 is switched in recording conveyance passage by a flapper 290, so that the sheet P is conveyed to a pair of rollers 300. After the sheet P is conveyed to the pair of rollers 300, the sheet P is conveyed backward by the pair of rollers 300, and is moved past the rollers 250 and 260, secondary transferring portion, and the fixing apparatus 100. Then, the sheet P is discharged into the delivery tray 280 by the rotation of the pair of discharge rollers 270.

<Fixing Apparatus 100>

Next, referring to FIGS. 15 and 16, the fixing apparatus 100 is described. FIG. 15 is a sectional view of the fixing apparatus 100. It shows the general structure of the fixing apparatus 100. FIG. 16 is a drawing for describing a frame and a covering member of the fixing apparatus 100.

The fixing apparatus 100 has a flexible, endless, and heat resistant belt 101 (hereafter is referred to as "sleeve") and a pressure roller 102, which are nip forming members. Further, the fixing apparatus 100 has: a heater 103, as a heating member, which is in the form of a piece of plate, a holder 104 as a holding member, a pressure bearing stay 105 as a pressure applying member, and a pair of flanges 106L (left) and 106R (right) as regulating members.

The heater 103 is supported by the holder 104 by lengthwise ends of the heater 103 in terms of the direction that is perpendicular to the direction in which a sheet P of recording medium is conveyed. The pressure stay 105 is mounted on the opposite surface of the holder 104 from the heater 103. The holder 104 is formed of heat resistant resin, such as liquid polymer, that is heat resistant and slippery. The sleeve 101 is fitted around the holder 104, on which the pressure stay 105 as well as the heater 103 are mounted. The sleeve 101 is roughly the same in circumference as the pressure roller 102.

The heater 103 has a substrate 103*a* that is long and narrow and is formed of dielectric ceramic. The heater 103 also has a heat generating resistor 103*b* that generates heat as electric current flows therethrough. The heat generating resistor 103*b* is attached to the opposite surface of the substrate 103*a* from the holder 104, in such a manner that the heat generating resistor extends in the lengthwise direction of the substrate 103*a*. Further, the heater 103 is provided with a dielectric protective layer 103*c* that is also placed on the opposite surface of the substrate 103*a* from the holder 104, in a manner to cover the heat generating resistor 103*b*.

In terms of the direction that is perpendicular to the conveyance direction of a sheet P of recording medium, the end portions of the sleeve 101 are fitted around the flanges 106L and 106R, one for one, so that the sleeve 101 can be rotated around the flanges 106L and 106R. Further, the lengthwise ends of the holder 104 are indirectly supported by the flanges 106L and 106R, with the placement of the pressure stay 105 between the holder 104 and the flanges 106L and 106R. As for the flanges 106L and 106R, they are supported by a pair of side plates 107L (left) and 107R (right), respectively.

The pressure roller 102 has: a metallic core 102*a*, an elastic layer 102*b* formed on the peripheral surface of the metallic core 102*a*, and a release layer 102*c* formed on the peripheral surface of the elastic layer 102*b*. In terms of the direction that is perpendicular to the recording medium conveyance direction, the metallic core 102*a* is rotatably supported by the pair of side plates 107L and 107R, by ends of the metallic core 102*a*, with the placement of an unshown pair of bearings between the lengthwise ends of the metallic core 102*a* and the side plates 107L and 107R.

In terms of the direction that is perpendicular to the recording medium conveyance direction, the lengthwise ends of the fixing apparatus 100 are provided with a pair of compression springs (unshown) that are disposed between the spring seats (unshown) of the pair of side plates 107L and 107R, and the flanges 106L and 106R, respectively. The flanges 106L and 106R are under the pressure generated by the compression springs in the direction that is perpendicular to the generatrix of the sleeve 101 by the compression springs. An arrow mark A in FIG. 6 indicates the direction in which the flanges 106L and 106R are pressed.

Since the flanges 106L and 106R are under the pressure, the holder 104 presses the heater 103 upon the inward surface of the sleeve 101, causing thereby the outward surface of the sleeve 101 to press on the peripheral surface (surface) of the pressure roller 102. Thus, the elastic layer 102*b* of the pressure roller 102 is elastically compressed (deformed). Consequently, a nip N having preset width is formed between the outward surface of the sleeve 101 and the peripheral surface of the pressure roller 102. The nip N is an area through which a sheet P of recording medium, which has a toner image T, is conveyed while remaining pinched between the sleeve 101 and the pressure roller 102.

<Thermal Fixing Operation>

As the driving force from a motor (unshown) is transmitted to the metallic core 102*a* of the pressure roller 102, the pressure roller 102 rotates in the direction indicated by an arrow mark in FIG. 15. Thus, the sleeve 101 is rotated by the rotation of the pressure roller 102 in the direction indicated by the arrow mark in FIG. 15, with an inward surface of the pressure roller 102 sliding on the protective layer 103*c* of the heater 103. As electric current flows through the heat generating resistor 103*b* to cause the heater 103 to generate heat, the heater 103 quickly increases in temperature, heating, thereby, the sleeve 101. The temperature of the sleeve 101 is detected by an unshown temperature detection element. The detected temperature is sent to the temperature control portion of the image forming apparatus 1001, so that the temperature control portion can control the amount by which electric power is supplied to the heater 103 to keep the detected temperature to remain at a preset level (target level).

After the formation of an unfixed toner image T on a sheet P of recording medium, the sheet P is conveyed to the nip N, and is conveyed through the nip N while being heated by the heat from the heater 103. Consequently, the toner image T on the sheet P becomes fixed to the sheet P.

<Structure of Frame 120>

Next, referring to FIGS. 15 and 16, the frame 120 of the fixing apparatus 100 is described.

All of the pair of side plates 107L and 107R, a stay 108, and a base plate 109 are formed of metallic plate. These components of the fixing apparatus 100 make up parts of the frame 120 of the fixing apparatus 100. They provide the fixing apparatus 100 with rigidity. In terms of the lengthwise direction of the fixing apparatus 100 that is perpendicular to the recording medium conveyance direction, the lengthwise ends of the stay 108 are connected to the pair of side plates 107L and 107R, one for one, on the sleeve side. Further, the lengthwise ends of the base plate 109 are connected to the pair of side plates 107L and 107R, one for one, on the pressure roller side. A front cover 112 that is L-shaped in cross section, is formed of resin. A bottom portion of the front cover 112 is connected to the stay 108, functioning thereby as a part of the frame 120 of the fixing apparatus 100.

That is, the frame 120 is made up of the pair of side plates 107L and 107R, the stay 108, the base plate 109, and the front over 112. This frame 120 internally holds: the sleeve 101 fitted around the combination of the heater 103, the holder 104, and the pressure roller 102, and the pressure roller 102 that forms the nip N in cooperation with the sleeve 101. In terms of the recording conveyance direction, the downstream end of the frame 120 has an opening 121 for allowing a sheet P of recording medium to move through the nip N. The fixing apparatus 100 is structured so that a sheet P of recording medium is introduced into the nip N through the area between the stay 108 and the base plate 109, and as the sheet P comes out of the nip N, the sheet P is discharged from the fixing apparatus 100 through the opening 121 after being conveyed through the area between the front cover 112 and the base plate 109.

Further, the pair of side plates 107L and 107R, the stay 108, and the base plate 109 are surrounded by a rear cover 110, a top cover 111, the front cover 112, a left cover 117L, and a right cover 117R. That is, the base plate 109 is surrounded by the rear cover 110, whereas the pair of side plates 107L and 107R are surrounded by the left and right covers 117L and 117R, respectively. Between the pair of side covers 117L and 117R, the pressure roller sides of the pair of side plates 107L and 107R are surrounded by the top cover 111, whereas the sleeve sides of the pair of side plates 107L and 107R are covered with the front cover 112. In other words, the fixing apparatus 100 is structured so that the pair of side plates 107L and 107R, the stay 108, and the base plate 109 cannot be touched by a user from outside the fixing apparatus 100.

The front cover 112 that faces the outward surface of the sleeve 101 is provided with a long and narrow opening 122 that is 16 mm in dimension (width) in terms of the vertical direction that is intersectional to the recording medium conveyance direction, and 200 mm in dimension (length) in terms of the horizontal direction (length) that also is intersectional to the recording medium conveyance direction. That is, the location of the opening 122 is different from that of the opening 121. This opening 122 is fitted with a piece of metallic net 113 that is for enhancing the collision of vaporized wax particles among themselves. The fixing apparatus 100 is structured so that air can freely flow through this opening 122 fitted with the metallic net 113, which is described later in greater detail.

<Airflow in Fixing Apparatus>

Next, referring to FIG. 17, the structure of the fixing apparatus 100 is described about the airflow in the fixing apparatus 100. Part (a) of FIG. 17 is a sectional view of the portion of the fixing apparatus 100 through which air is drawn out of the fixing apparatus 100. Part (a) of FIG. 17 is for describing the airflow in the fixing apparatus 100. Part (b) of FIG. 17 is a perspective view of a combination of the frame 120, an air duct 114, a fan 115, and an electrical portion 118. Part (b) of FIG. 17 is for showing the airflow from the opening 122 of the frame 120 to the electrical portion 118.

The air duct 114 is formed of resin. It is an air duct with which the image forming apparatus main assembly 1001A is provided. The air duct 114 connects between the front cover 112 and the fan 115. The image forming apparatus main assembly 1001A is provided with the fan 115 that is an axial flow fan, the blade angle of which is 30 degrees. The fan 115 draws air from the air duct 114, and discharges the air into the electrical portion 118 of the image forming apparatus main assembly 1001A. That is, the wax vapor generated from toner by the sleeve 101 passes through the openings of the metallic net 113 of the front cover 112, and the air duct 14. Then, the wax vapor is discharged into the electrical portion 118 by the fan 115. As the wax vapor is made to flow through the air duct 114, and is discharged into the electric portion 118, the wax vapor adheres to the surfaces of the air duct 114 and the electrical portion 118.

At this time, referring to FIG. 15, the mechanism of the generation of wax vapor from toner is described.

The developing devices 130Y, 130M, 130C and 130K of the image forming stations SY, SM, SC, and SK of the image forming portion 1000 contain toner. Toner contains hydrocarbon wax, such as paraffin wax, polyethylene wax, and polypropylene wax.

As a toner image T is conveyed through the nip N, the wax in the toner image T is liquefied by heat and pressure, and oozes out onto the surface of the toner image T. As the liquefied wax oozes out, a part of the liquefied wax vaporizes into the ambient air. As the wax vaporizes, it turns into microscopic particles that float in the air. The longer the wax vapor floats in the air, the more likely the wax vapor is to agglutinate into microscopic particles that adhere to the adjacent members. Generally speaking, therefore, it has been desired to cover the adjacencies of the sleeve 101 with a particle capturing member to cause the wax vapor to temporarily remain in the adjacencies of the sleeve 101.

As an image forming apparatus 1001 is increased in speed, however, no matter how cleverly the adjacencies of the sleeve 101 are covered with the wax vapor capturing member, the covering member is defeated by the airflow that is generated by the conveyance of a sheet P of recording medium, allowing, therefore, the wax vapor to disperse into the airflow, and to be conveyed to the recording medium conveyance passage.

As the wax vapor was conveyed to the recording medium conveyance passage, it occurred that the wax vapor adhered to the conveyance guide, the roller 270, the roller 30, etc., that are on the downstream side of the fixing apparatus 100, interfering thereby the recording medium conveyance and/or reducing the rollers 270 and 300 in coefficient of friction.

In comparison, in the case of the image forming apparatus 1001 in this embodiment, image forming apparatus main assembly 1001A and the fixing apparatus 100 are structured so that the wax vapor is dispersed into the air flow indicated by arrow marks in FIG. 7, and is conveyed by the airflow to the electrical portion 118. Therefore, it does not occur that the wax vapor adheres to the conveyance guide, and/or the rollers 270 and 300.

<Structure of Metallic Net>

According to the general theory of movement of gaseous particles, the higher the temperature, the faster the particle speed of the gaseous particles. Further, the faster the particle speed of the gaseous particles, the higher the frequency with which they collide with each other. The metallic net 113 in this embodiment is constructed to utilize this property of the gaseous particles. That is, the air passage (air duct) 114 is increased in temperature to increase the wax vapor in temperature to increase the frequency with which the wax particles collide with each other, and/or with the adjacent members, so that they adhere to the air duct 114 and/or the electrical portion 118.

The reason why the metallic net 113 was employed is as follows.

The employment of the metallic net 113 makes it possible to increase the air passage (wax vapor passage) in temperature without an additional heat source. More specifically, the metallic net 113 is small in thermal capacity, and, therefore, it is quickly increased in temperature by the airflow from the sleeve 101, and then, increases ambient temperature, even though it has a certain amount of distance from the sleeve 101. This is possible because the metallic net 113 is formed of a metallic substance that is smaller in specific heat. Further, the metallic net is formed by weaving fine metallic wire, being, therefore, small in mass.

Another reason is that the metallic net 113 is unlikely to interfere with the airflow.

If steel wool or the like that is higher is strand density than the metallic net 113 is employed in place of the metallic net 113, the wax vapor is likely to flow into the recording medium conveyance passage. Thus, the steel wool or the like is less desirable from the standpoint of the above-described effect, for the following reason. That is, a material that is high in strand density interferes with the airflow, reducing thereby the amount by which air flows from the adjacencies of the sleeve 101 to the air duct 114 or the electrical portion 118. Thus, it becomes necessary to increase the fan 115 in capacity, and, therefore, it becomes necessary to deal with the issues related to the size and cost of the image forming apparatus 1001.

In comparison, in this embodiment, the metallic net 113, the material of which was metallic wire that is 0.1 mm to 0.3 mm in diameter, and that is 10 to 30 meshes/inch, was used as the metallic net 113. Thus, it did not occur that the amount by which air is drawn out of the fixing apparatus 100 was significantly affected. Therefore, it did not occur that the airflow from the sleeve 101 to the air duct 114 and the electrical portion 118 is interfered by the metallic net 113.

From the standpoint described above, a piece of metallic net that was woven of SUS304 wire was used as the metallic net 113. The wire was 0.25 mm in diameter. The mesh count was 20 meshes/inch. The wire mesh was cut to a piece that was 20 mm×220 mm in size, and was thermally welded to the sleeve side edge of the opening 122 of the front cover 112.

Effects of Embodiment

In order to quantitatively confirm the effects of this embodiment, the wax vapor particles in the adjacencies of the roller 270 were cumulatively counted, with the use of a nano-particle counter FMPS (product of TSI), for 10 minutes while images were printed. The results are shown in Table 1. By the way, Table 1 shows the results related to the fifth embodiment of the present invention that will be described later.

TABLE 1

| | Reduction ratios |
|---|---|
| Comp. Example (Ref) | — |
| Embodiment 1 | 50% |
| Embodiment 2 | 40% |

In the case of the referential fixing apparatus, a piece of a plate that was molded of the same material as the one for the front cover 112, was pasted to the front cover 112 in a manner to entirely cover the metallic net 113 to plug the opening 122. In comparison, in the case of the fixing apparatus 100 in this embodiment (embodiment 4), the nano-particle count was half the nano-particle count of the comparative fixing apparatus. Thus, it was confirmed that this embodiment was able to effectively reduce a fixing apparatus in the number by which wax vapor particles are dispersed by the airflow generated by the conveyance of a sheet P of recording medium.

As described above, the image forming apparatus 1001 in this embodiment was structured so that the air in the frame 120 is drawn out of the frame 120 through the opening 122 with which the frame 120 of the fixing apparatus 100 is provided, and also, so that the colliding of the wax vapor particles among each other is enhanced by the metallic net 113 with which the opening 122 is provided. Thus, it is possible to efficiently capture the wax vapor.

Embodiment 5

Next, another embodiment of the present invention is described. The image forming apparatus 1001 in this embodiment is described about only the portions that are different in structure from the counterparts in the fourth embodiment.

In the fourth embodiment, the metallic net 113 was used as a member for promoting the collision of the wax vapor particles among themselves. In this embodiment that is described next, metallic coil springs 116 were used in place of the metallic net 113.

FIG. 18 is a perspective view of the front cover 112 of the frame 120 of the fixing apparatus 100 of the image forming apparatus 1001 in this embodiment.

Each metallic spring 116 is made of SUS304 wire, and is 0.20 mm in wire diameter, 3 mm in diameter, and 300 in winding count. In this embodiment, three metallic springs 116 were employed. Each spring 116 was attached to the frame 120 in such a manner that its lengthwise end portions were hooked to unshown protrusions, with which the inwardly facing left and right surfaces of the opening 122 of the front cover 112 are provided, being thereby stretched to a length of 220 mm. The reason why the metallic springs 116 were used in place of the metallic net 113 is that not only do the springs 116 impede air flow as minimally as the metallic net 113 in the fourth embodiment, and are as small in thermal capacity as the metallic net 113 in the fourth embodiment, but also, it can make it easier to assemble the fixing apparatus 100 as compared to assembling the fixing apparatus 100 having the metallic net 113 in the fourth embodiment.

In order to quantitatively confirm the effects of this embodiment, the cumulative number of the wax vapor particles in the adjacencies of the roller 270 was counted, while a printing operation was carried out for ten minutes, as it was to test the effects of the fourth embodiment. Referring to Table 1 that shows also the results of the test carried out to confirm the effects of the fourth embodiment, it was confirmed that the fifth embodiment also was able to effectively reduce the fixing apparatus 100 in the amount of the wax vapor adhesion better than the comparative fixing apparatus, although it was not as effective in terms of the reduction ratio as the fourth embodiment.

As described above, in the case of the image forming apparatus 1001 in this embodiment, not only was the air in the fixing apparatus 100 drawn out of the fixing apparatus 100 through the opening 122 of the frame 120, but also, the collision of the wax vapor particles among themselves was promoted by the metallic springs 116 with which the opening 122 was provided. Thus, it was possible to efficiently capture the wax vapor particles.

<Miscellaneous>

In the case of the images forming apparatuses 1001 in the fourth and fifth embodiments, the opening 122 of the front cover 112 was fitted with the metallic net 113 and metallic springs 116, respectively. These embodiments, however, are not intended to limit the present invention in scope in terms of the positioning of the metallic net 113 or the metallic springs 116. That is, it may be the air duct 114 that is provided with the metallic net 113 or the metallic springs 116. Further, not only is the present invention applicable to a full-color image forming apparatus, but also a monochromatic (black-and-white) image forming apparatus. Moreover, not only is the present invention applicable to a fixing apparatus that employs a sleeve, but also, to fixation apparatuses that are different in structure from those in the preceding embodiments. For example, the present invention is also applicable to a fixing apparatus of the heat roller type that employs a fixation roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus for forming a toner image on a recording material, said image forming apparatus comprising:

a main assembly;

an image forming station provided in said main assembly and configured to form the toner image on the recording material;

a fixing portion provided in said main assembly and configured to fix the toner image formed on the recording material, on the recording material, said fixing portion including a fixing rotatable member and a covering member having an opening and covering said rotatable member; and a suction mechanism including a duct connected with said opening provided in said covering member, and a fan configured to suck air inside said covering member through said duct, wherein the air sucked by said suction mechanism is discharged from said fan into a space in said main assembly other than a space through which the recording material passes, and wherein the space in said main assembly through which the air is discharged is provided outside of the space through which the recording material passes relative to a lengthwise direction of said fixing portion.

2. The image forming apparatus according to claim 1, wherein said opening provided in said covering member is in the form of a slit.

3. The image forming apparatus according to claim 1, wherein the air sucked by said suction mechanism is discharged into a space in which a driving unit is accommodated.

4. The image forming apparatus according to claim 3, wherein the air sucked by said suction mechanism is discharged so as to impinge on a driving motor.

5. The image forming apparatus according to claim 3, further comprising an electrical equipment portion provided in the space in said main assembly other than the space through which the recording material passes.

6. The image forming apparatus according to claim 1, further comprising an electrical equipment portion provided inside said main assembly, wherein the air sucked by said suction mechanism is discharged to said electrical equipment portion.

7. The image forming apparatus according to claim 1, wherein said opening provided in said covering member is provided with a metal net through which the air sucked by said suction mechanism passes.

8. The image forming apparatus according to claim 1, wherein said opening provided in said covering member is provided with a metal spring through which the air sucked by said suction mechanism passes.

9. An image forming apparatus for forming a toner image on a recording material, said image forming apparatus comprising:

a main assembly;

an image forming station provided in said main assembly and configured to form the toner image on the recording material;

a fixing portion provided in said main assembly and configured to fix the toner image formed on the recording material, on the recording material;

a fan configured to suck air inside said fixing portion; and a metal net through which the air sucked by said fan passes, said metal net being formed of a material that is a metallic wire having a diameter of 0.1 mm to 0.3 mm and that is 10 to 30 meshes/inch.

10. The image forming apparatus according to claim 9, wherein said metal net is disposed between said fan and said fixing portion.

11. The image forming apparatus according to claim 9, further comprising an electrical equipment portion provided inside said main assembly, wherein the air sucked by said fan is discharged toward said electrical equipment portion.

12. An image forming apparatus for forming a toner image on a recording material, said image forming apparatus comprising:

a main assembly;

an image forming station provided in said main assembly and configured to form the toner image on the recording material;

a fixing portion provided in said main assembly and configured to fix the toner image formed on the recording material, on the recording material;

a fan configured to suck air inside said fixing portion; and a metal spring through which the air that is sucked by said fan passes, said metal spring having a winding direction that crosses a direction in which the air passes.

13. The image forming apparatus according to claim 12, wherein said metal spring is disposed between said fan and said fixing portion.

14. The image forming apparatus according to claim 12, further comprising an electrical equipment portion provided inside said main assembly, wherein the air sucked by said fan is discharged toward said electrical equipment portion.

15. The image forming apparatus according to claim 12, wherein said metal spring comprises a coil spring.

16. The image forming apparatus according to claim 12, wherein the fixing portion has an opening downstream of the fan with respect to the direction in which the air passes, through which the air sucked by the fan is discharged, the opening having a width along a direction that is perpendicular to the direction in which the air passes, and wherein the metal spring spans the width of the opening.

* * * * *